US009284105B2

(12) United States Patent
Ghezzi

(10) Patent No.: US 9,284,105 B2
(45) Date of Patent: Mar. 15, 2016

(54) APPARATUS AND PROCESS FOR PACKAGING CONTAINERS OF LIQUID PRODUCTS INTO BUNDLES

(75) Inventor: Alessandro Angelo Ghezzi, Cernusco sul Naviglio (IT)

(73) Assignee: AETNA GROUP S.P.A., Villa Verucchio (RN) (IT)

( * ) Notice: Subject to any disclaimer, the term of this patent is extended or adjusted under 35 U.S.C. 154(b) by 918 days.

(21) Appl. No.: 13/392,780

(22) PCT Filed: Aug. 23, 2010

(86) PCT No.: PCT/IB2010/002062

§ 371 (c)(1),
(2), (4) Date: Feb. 27, 2012

(87) PCT Pub. No.: WO2011/024050

PCT Pub. Date: Mar. 3, 2011

(65) Prior Publication Data

US 2012/0151879 A1 Jun. 21, 2012

(30) Foreign Application Priority Data

Aug. 28, 2009 (IT) ..... MI2009A1512

(51) Int. Cl.
*B65B 11/06* (2006.01)
*B65B 35/36* (2006.01)
(Continued)

(52) U.S. Cl.
CPC ..... *B65D 71/08* (2013.01); *B65B 11/025* (2013.01); *B65B 21/245* (2013.01); *B65B 27/04* (2013.01); *B65D 65/40* (2013.01)

(58) Field of Classification Search
CPC ..... B65B 11/06; B65B 35/36; B65B 35/30; B65B 63/02; B65B 21/245; B65B 27/04; B65B 11/025; B65B 35/56; B65D 71/08; Y10S 901/07
USPC ..... 53/220, 225, 389.4, 389.3, 448, 543, 53/203, 461, 411
See application file for complete search history.

(56) References Cited

U.S. PATENT DOCUMENTS

| | | | | |
|---|---|---|---|---|
| 4,524,568 | A | 6/1985 | Lancaster et al. | |
| 5,907,943 | A | 6/1999 | Eichbauer | |
| 7,219,485 | B2 * | 5/2007 | Battisti | 53/542 |
| 2003/0024213 | A1 * | 2/2003 | Cere' | 53/441 |

FOREIGN PATENT DOCUMENTS

| | | |
|---|---|---|
| CA | 2569045 | 6/2008 |
| DE | 1786485 | 12/1975 |

(Continued)

OTHER PUBLICATIONS

International Search Report dated Dec. 21, 2010 in corresponding International Application No. PCT/IB2010/002062, 5 pages.

*Primary Examiner* — Robert Long
*Assistant Examiner* — Xavier A Madison
(74) *Attorney, Agent, or Firm* — Duane Morris LLP

(57) ABSTRACT

An apparatus for packaging groups of contains of liquid products into bundles includes at least one pair of wrapping stations of groups of containers. Each station is configured to wrap an extensible film around a group of containers and to feed and discharge the groups of containers to/from the wrapping station and includes at least one feeding line of the containers and at least one discharge line of the bundles. Advantageously, the feeding and discharge lines are shared between different wrapping stations.

20 Claims, 17 Drawing Sheets

(51) Int. Cl.

| | |
|---|---|
| ***B65B 41/10*** | (2006.01) |
| ***B65B 35/30*** | (2006.01) |
| ***B65D 71/08*** | (2006.01) |
| ***B65B 11/02*** | (2006.01) |
| ***B65B 21/24*** | (2006.01) |
| ***B65B 27/04*** | (2006.01) |
| ***B65D 65/40*** | (2006.01) |

(56) References Cited

FOREIGN PATENT DOCUMENTS

| | | |
|---|---|---|
| DE | 3910823 A1 | 10/1990 |
| EP | 0781651 | 7/1997 |
| IT | 1219724 | 5/1990 |
| WO | WO9302860 | 2/1993 |

* cited by examiner 12
3
3
3
9
4

12
3
3
6
3
500
4

12
504
3
3
3
500
503
2
4

12
504
3
3
3
2
500
503
4

APPARATUS AND PROCESS FOR PACKAGING CONTAINERS OF LIQUID PRODUCTS INTO BUNDLES

CROSS REFERENCE TO RELATED APPLICATIONS

This application is a national phase application under 35 U.S.C. §371 of internal patent application PCT/IB/2010/002062, filed on Aug. 23, 2010, the entirety of which is herein incorporated by reference.

BACKGROUND OF THE INVENTION

The present invention refers to an apparatus and a process for packaging containers of liquid products, in particular groups of bottles containing water or other beverages, into bundles.

PRIOR ART

It is known to package groups of containers for liquid products into bundles that are easy for a single person to transport. For example, it is particularly common for supermarkets to sell bundles formed with six bottles of water or soft drinks; generally, bottles sold in bundles are made from polyethylene terephthalate PET, and more rarely they are made from glass.

The packaging of bundles of PET bottles is normally carried out by means of automated apparatuses that take care of grouping the bottles and wrapping the groups thus formed with a film of heat-shrinking plastic material, typically low-density polyethylene LDPE. Such a film is wrapped around the group of bottles to be packaged, so as to at least partially overlap the opposite edges of the film. The overlapping edges are thermowelded in a special thermowelding station of the packaging apparatus; a joint is thus created that gives the film a configuration like a substantially annular band, inside which the bottles are collected. In a subsequent step of the packaging process, the group of bottles, wrapped in the annular band of heat-shrinking film, is transferred to a heating station of the packaging apparatus inside which the temperature of the air is sufficiently high (180° C.-190° C.) to cause the film to shrink. Generally, the heating station is a tunnel type furnace.

In the heating station the film shrinks onto the group of bottles, trapping it; in practice, the annular band defined by the film moulds over the outside of the grouped bottles, pressing them against one another and forming a bundle.

In general, the bundles can comprise two, four, six bottles, etc.

Italian application ITMI2009 A001512, the priority of which is claimed, describes a process for packaging containers for liquids in which the wrapping of the groups of containers is carried out cold, i.e. without heating devices, using a film of non-heat shrinking low density extensible linear polyethylene. The film is wrapped in many layers over the relative group of containers; the different layers of film stick to one another creating a sufficiently rigid wrapping for the formation of the bundle. The bundles formed with the extensible film have a lower weight with respect to the bundles formed with heat-shrinking film, with clear advantages in terms of the transportation of large quantities of containers and the disposal of the film after the bundle is opened. It is also clear that there is a saving relating to the lower amount of material used to make the film.

U.S. Pat. No. 4,524,568 describes an apparatus for packaging pallets provided with a single wrapping station of a film of low density linear polyethylene. The film is subjected to a pre-tensioning step before the relative wrapping. The pallets to be packaged are fed to the wrapping station through a single conveyor belt. The wrapping direction of the film around the pallet is circumferential with respect to the direction of forward movement of the pallets themselves. The packaged pallets, i.e. wrapped in the film, are discharged from the wrapping station by means of a single conveyor belt.

US patent application n. 2003/0024213 describes an apparatus for packaging groups of bottles in bundles. With an extensible film an annular (or tubular) band is formed that is subsequently radially stretched in a preforming station to allow the insertion inside it of a group of containers to be packaged. The subsequent release of the annular band causes its elastic return onto the group of containers and the consequent formation of the compact bundle. The bottles to be packaged are fed to the preforming station through a single conveyor belt. The packaged bundles, i.e. the groups of bottles held together in the film, are discharged from the preforming station by means of a single conveyor belt.

German patent application DE 3910823A describes an apparatus for packaging bottles in bundles. The apparatus comprises a station for wrapping the groups of bottles with an extensible film, a conveyor belt for feeding the preformed groups of bottles going into the wrapping station and a conveyor belt for discharging the bundles of bottles going out from the wrapping station. The wrapping direction of the film around the bottles is circumferential with respect to the direction of forward movement of the groups of bottles (which always remain vertical). At the wrapping station, the bottles are supported vertically against falling by special linear guides that engage the neck of the bottles themselves and that allow the finished bundle to slide forwards, towards the discharging conveyor.

It is clear from the previous description that the use of the extensible film instead of the heat-shrinking film allows the packaging apparatus to be simplified, no longer needing the thermowelding station and the heating station.

Despite the simplification introduced, there is still a substantial drawback. The possible shut down of the wrapping or preforming station causes the interruption of the packaging process of the products. On the other hand, there is a need to redesign the packaging apparatus to obtain the maximum productivity, minimising the occurrence of shut downs.

SUMMARY OF THE INVENTION

The purpose of the present invention is therefore to provide an apparatus for packaging containers for liquids in bundles the productivity of which is maximised with respect to conventional apparatuses.

In a first aspect thereof, the invention therefore concerns an apparatus for packaging containers for liquids in bundles according to claim 1.

In particular, the invention concerns an apparatus for packaging containers for liquids in bundles, comprising:

at least one pair of stations for wrapping groups of containers in bundles, each station in turn comprising means for wrapping an extensible film around a group of containers and manipulating means for feeding and discharging said groups of containers to/from the wrapping station;

at least one line for feeding the containers to be packaged;

at least one line for discharging the containers packaged in bundles;

in which there is one feeding line and it is intermediate with respect to the wrapping stations of each pair of wrapping stations and in which there are at least two discharge lines, each of which is opposite said feeding line with respect to the corresponding wrapping station or, vice-versa, there is one discharge line and it is intermediate with respect to the wrapping stations of each pair of wrapping stations and in which there are at least two feeding lines, each of which is opposite said discharge line with respect to the corresponding wrapping station.

Advantageously, the layout of the apparatus foresees at least one pair of wrapping stations, and preferably many pairs, for example two, three, four, etc., and feeding and discharge lines that extend so as to be able to serve many wrapping stations at once. In other words the feeding and discharge lines are shared. This characteristic makes it possible to not interrupt the packaging process in the case in which a wrapping station shuts down, for example due to a failure. The remaining stations continue to operate, fed by the feeding line, or by the feeding lines.

By the term layout we mean the arrangement of the different components or modules of the apparatus and of the relative lines for feeding the containers and discharging the bundles.

In general, the feeding lines extend substantially at the same height with respect to said discharge lines or else at different heights. Preferably, the discharge lines are raised, i.e. at a greater height, with respect to the feeding line(s).

In general, each feeding line and each discharge line is a single track or, alternatively, each line is split into many tracks, in each of which the groups of containers/bottles can move.

Preferably, each feeding line and discharge line comprises at least one conveyor belt, or else many conveyor belts in series and/or in parallel. In practice, each conveyor belt is configured as a track for the groups of containers in movement towards or away from the wrapping station.

Preferably each wrapping station comprises a gripping group of a group of containers to be packaged in bundles and the manipulating means comprise:

a first mechanical arm, moveable between a first position for picking up the group of containers from a feeding line and a second position for delivering the group of containers to the gripping group, and a second mechanical arm moveable between a first position for picking up the bundle of containers from the gripping group and a second position for releasing the bundle of containers onto a discharge line.

Preferably, the gripping group comprises at least two U-shaped jaws, able to move one against the other along a longitudinal axis to laterally clamp a group of containers and hold them in vertical position without engaging the respective upper portion and the lower portion. The gripping group laterally presses the group of containers, for example six bottles, leaving the upper portion, where the neck of the bottles with the relative cap is located, and the lower portion, where the bottom of the bottles is located, completely free. In this way, the gripping group makes it possible to package bottles with a strip of film wrapped around the sides of all of the bottles and around the relative upper and lower portions. As will be described, the side portions of the two jaws remain temporarily wrapped together with the bottles before the gripping group is opened, i.e. until the two jaws are separated to free the bundle.

Preferably, the means for wrapping the film around the group of containers comprise a reel-carrying group suitable for horizontally supporting, for example canti-levered, a reel of the film. The reel-carrying group is able to rotate around the longitudinal axis of the gripping group to allow the strip of film to be unwound as described above.

More preferably, the reel-carrying group comprises:

a bracket or other support element of the shaft of a reel of the film and an internally toothed wheel, mounted so as to be able to rotate on a special frame, the rotation axis of which coincides with the longitudinal axis of the gripping group. The bracket is integral with, or fixed to, the internally toothed wheel.

Preferably, the apparatus also comprises actuator means of the reel-carrying group. Such actuator means in turn comprise an electric motor and an externally toothed wheel, fitted onto the shaft of the electric motor and in direct engagement with the internally toothed wheel. The rotation of the drive shaft therefore causes the rotation of the internally toothed wheel with respect to the relative support frame and, consequently, causes the rotation of the reel-carrying bracket around the longitudinal axis.

Preferably, the apparatus also comprises a support group of the containers in addition to the gripping group described above. The support group in turn comprises:

a horizontal plate, or tray, able to move parallel to the longitudinal axis of the gripping group between a first retracted position, at which the plate does not support the group of containers, and an extended position, at which the plate supports from below at least some of the containers clamped in the gripping group, and actuator means of the support plate.

Preferably, the bottles supported by the support plate actually come into contact with the plate itself (the bottom of some of the bottles rests on the upper surface of the plate). Alternatively, between the support plate and the bottles there can still be a small gap if the bottles are effectively supported also by one of the mechanical arms; in this circumstance, the support plate prevents the possible vertical falling of the bottles in the case in which the mechanical arm is not totally effective.

The support group has the function of supporting the containers of the group fed to the wrapping station when the gripping group is not operative, i.e. when the relative jaws are not yet clamped on the group of containers to be wrapped with the film, or else when the jaws are separated to allow the discharge of the bundle formed. In practice, the containers rest on the plate of the support group when they are not laterally supported by the jaws of the gripping group and when they are not held by one of the mechanical arms.

Preferably, the apparatus also comprises a pincer group intended to lock a portion of the strip of film at the group of containers clamped between the jaws of the gripping group. The pincer group comprises:

a jaw, able to move in abutment against the plate of the support group to lock the film and prevent it from sliding, and actuator means of the jaw suitable for thrusting it against the plate of the support group, when the latter is in the relative extended position.

Preferably, the apparatus also comprises an element for cutting the film moveable parallel to the longitudinal axis of the gripping group, near to the lower perimeter of the bundle in formation. The cutting element has the function of separating the strip of film into two edges. One edge sticks to the bundle formed in the wrapping station; the remaining edge remains locked by the pincer group and constitutes the starting point of a new bundle.

The pincer group and the cutting element can be actuated simultaneously or rapidly one after the other.

Preferably, the cutting element is independent, i.e. it is provided with its own independent actuator means with respect to the pincer group and to the support group. Alternatively, the cutting element is actuated in subordination to the pincer group and/or to the plate of the support group; in this circumstance the actuator means of the cutting element are supported or fixedly connected to the pincer group and/or to the support group.

With reference to the example case of packaging of bottles of water in bundles, the operation of the apparatus according to the present invention will now be described, provided with at least one pair of wrapping stations, each of which comprises the manipulating means, the gripping group, the support group and the cutting element.

A plurality of bottles, preferably grouped in a predetermined number of units in a grouping station arranged upstream of the wrapping station with respect to the direction of movement of the bottles themselves, are fed to the wrapping station by the feeding line. For example, the bottles are fed in groups of six to the wrapping station by a conveyor belt.

The first mechanical arm of the manipulating means of a wrapping station picks up a group of six bottles from the conveyor belt, which for example is intermediate with respect to the two stations of the wrapping pair of the apparatus, and places it on the support plate of the support group of that wrapping station; the plate is located in the relative extended position and prevents the group of bottles from falling vertically when the mechanical arm is not active on the bottles.

The jaws of the gripping group move against one another and laterally lock the group of six bottles. The jaws embrace all of the bottles, leaving the lower portion and the upper portion of each bottle free. The first mechanical arm goes back into the initial position to pick up a new group of bottles from the conveyor belt of the feeding line.

In this circumstance the pincer group is active and the relative jaws keep the free edge of the strip of film locked against the support plate. In particular, the jaw of the pincer group is in abutment against the lower surface of the support plate and the film is held between these elements. The bottles rest on the upper surface of the support plate.

The motor of the reel-carrying group is activated to rotate the internally toothed wheel around the longitudinal axis of the gripping group. Consequently, the reel of film rotates around the group of bottles held by the gripping group. The film unwinds onto the group of bottles and onto the jaws of the gripping group.

Before the completion of the first rotation of the internally toothed wheel, and thus before the film has wrapped the group of bottles with a complete rotation, the pincer group is deactivated, i.e. the relative jaw frees the film, and the support plate of the support group is retracted to allow the bottom of the bottles to also be wrapped. In this circumstance the film has already stuck on top of the group of bottles and although it is no longer held by the pincer group, it does not disengage from the bottles.

After the support plate pulls back, the internally toothed wheel and therefore the reel of film perform many revolutions around the group of bottles, preferably three, to complete the bundle.

When the penultimate revolution of the reel-carrying group is complete, the support plate is brought back into the extended position to support at the bottom the bundle being completed and the pincer group is activated to lock the film against the support plate.

At the end of the last revolution, the pincer group, after having been moved longitudinally in the axial direction, is activated to lock the film against the support plate, in particular against its lower surface. The cutting element is activated at the same time as or immediately after the pincer group; the cutting element moves parallel to the longitudinal axis of the gripping group, preferably parallel and alongside the support plate, to cut the strip of film into two edges. A first edge stays locked in the pincer group, ready for the packaging of a new group of bottles; the second edge sticks to the bundle already formed. The jaws of the gripping group open to free the formed bundle, sliding between the bottles and the layers of film wound over them. At the same time, the second manipulating arm of the manipulating means of the wrapping station picks up the bundle and delivers it to the discharge line, for example a discharge conveyor belt raised with respect to the feeding conveyor belt and positioned opposite it with respect to the reel-carrying group.

The operation of the apparatus is repeated for the packaging of a new group of bottles.

As an alternative to the solution just described, the discharge conveyor belt can be intermediate between the two wrapping stations of the same pair and there are two feeding conveyor belts, outside of the pair of wrapping stations.

The productivity of the apparatus according to the present invention is high; the possible shut down of a wrapping station does not prevent the other station of the same pair from continuing to work.

Preferably, there are more than two pairs of wrapping stations, more preferably there are three (in total six wrapping stations) and the feeding and discharge lines are shared between the pairs of stations.

In a second aspect thereof, the present invention concerns an apparatus according to claim 14, for packaging containers for liquids in bundles. In particular, the apparatus comprises at least one wrapping station of groups of containers in bundles, the station in turn comprising:

a gripping group comprising at least two U-shaped jaws, able to move one against the other along a longitudinal axis to laterally clamp a group of containers and hold them in vertical position without engaging the upper portion and the lower portion, means for wrapping an extensible film around the group of containers held by the gripping group, the wrapping direction of the film being circumferential with respect to the longitudinal axis of the gripping group, and an element for cutting the film, able to move parallel to the longitudinal axis of the gripping group, near to the lower perimeter of the bundle in formation, to separate the part of the film wrapped over the bundle of containers from the remaining part of film.

The mutual arrangement of the gripping group, the means for wrapping the film and the cutting element makes it possible to minimise the production time of the bundle and to simplify the structure of the apparatus as much as possible. In practice, these components move along the longitudinal axis (jaws of the gripping group) or around such an axis (reel-carrying group), with clear advantages in terms of the internal layout of the wrapping apparatus (irrespective of the arrangement of the feeding and discharge lines).

Preferably, the apparatus also comprises a support group of the group of containers, a pincer group and a cutting element having the characteristics described above in relation to the first aspect of the invention.

In a third aspect thereof the invention concerns a process for packaging groups of containers for liquids, according to claim 18.

In particular, the invention concerns a process comprising the steps of:

a) forming a group of containers;

b) wrapping the group of containers around a longitudinal axis with a film of non-heat-shrinking extensible plastic material;

c) locking the film at the bundle in formation;

d) cutting the film to separate the portion wrapped over the bundle from the remaining part, in which step d) is carried out with a cutting element able to move alternately in a direction parallel to said longitudinal axis.

In general, the steps c) and d) can be carried out simultaneously, or else step d) is carried out with a certain delay with respect to step c) or when such a step has already ended.

Preferably, the cutting element is able to translate alternately in the two directions along a direction parallel to the longitudinal axis. More preferably, the longitudinal axis coincides with the axis of a gripping group.

Advantageously, the cutting element does not hinder the wrapping of the containers precisely in virtue of its longitudinal and not transversal movement.

Preferably, step c) is carried out through a pincer group comprising at least one jaw and relative actuator means suitable for thrusting the jaw against an abutment surface, for example the support plate described above. In this circumstance the cutting element comprises relative actuator means that are independent or fixedly connected to the pincer group.

BRIEF DESCRIPTION OF THE FIGURES

Further characteristics and advantages of the present invention will become clearer from the following description of a preferred embodiment thereof, given hereafter, for indicating and not limiting purposes, with reference to the attached drawings. In such drawings.

DETAILED DESCRIPTION OF A PREFERRED EMBODIMENT OF THE INVENTION

Figure 3:
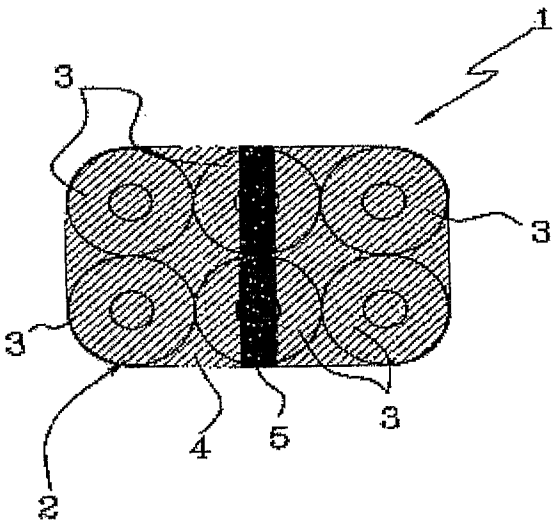
FIG. 3 is a view from above of the bundle according to the previous figures.

With reference to the attached figures, reference numeral 1 wholly indicates a bundle of containers for liquid food products, in particular bottles of water and/or beverages.

As can be seen in FIGS. 1 to 3 and 15 to 17, the bundle 1 is made up of at least one group 2 of containers 3, preferably six, for liquid food products. In particular, the containers 3 comprise bottles of water and/or beverages, and the bundles can also foresee a number of containers 3, equal to two or four containers 3, or even more than the conventional number of six. In particular, the containers 3 are arranged so as to form a compact core in which each container 3 is arranged against at least one other container 3 in contact with each other.

The aforementioned bundle 1 also comprises at least one film of plastic material wrapped around the group 2 of containers 3. In this way the containers 3 are at least partially covered by the film 4 that lightly presses one container 3 against the other.

The film 4, wrapped around the group 2 of containers 3 by means of an apparatus according to the present invention, is made from plastic material; in particular, it is a film 4 of extensible linear low-density polyethylene (LLDPE), preferably not heat-shrinking (or thermoshrinkable). Therefore, the application of such a film 4 onto the group 2 of containers 3 is not carried out through heating and feeding into a furnace, but instead by means of cold wrapping.

Preferably, the film 4 is wrapped around the group 2 of containers 3 following a pre-stretching.

Preferably, the film 4 has a thickness of no more than 10 microns, even more preferably between 8 and 10 microns.

The film 4 is advantageously added to with at least one polymer, preferably metallocene, according to a percentage of between 5% and 25%, preferably between 10% and 20% per Kg. In this way the mechanical strength of the film 4 is increased giving the bundle 1 the ideal resistance to the relative manipulation during transportation and from consumers.

Advantageously, the film 4 of extensible linear low-density polyethylene (LLDPE) has at least one surface, preferably inner, in other words intended to engage the group 2 of containers 3, provided with a layer of gluing substance. In this way, the inner surface can firmly engage the group 2 of containers 3 without however staying definitively glued to it. In other words, the gluing substance is able to ensure the stable engagement of the film on the group 2 avoiding it from strongly welding to the containers 3.

In order to ensure the effect just described, the gluing substance is present in the film 4, preferably according to a percentage of between 10% and 20%, even more preferably between 13% and 18% per Kg.

Going into greater detail, the film 4 of extensible low-density polyethylene (LLDPE) has a weight per bundle 1 of no more than 20 grams, preferably no more than 10 grams, even more preferably between 5 grams and 10 grams.

Figure 2:
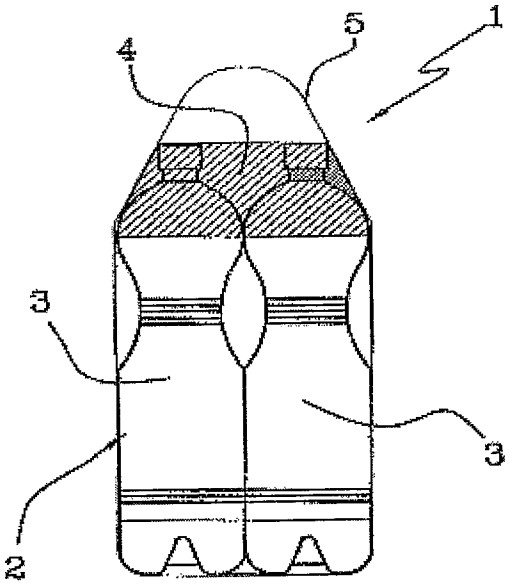
FIG. 2 is a side view of the bundle according to the previous figure.
Figure 1:
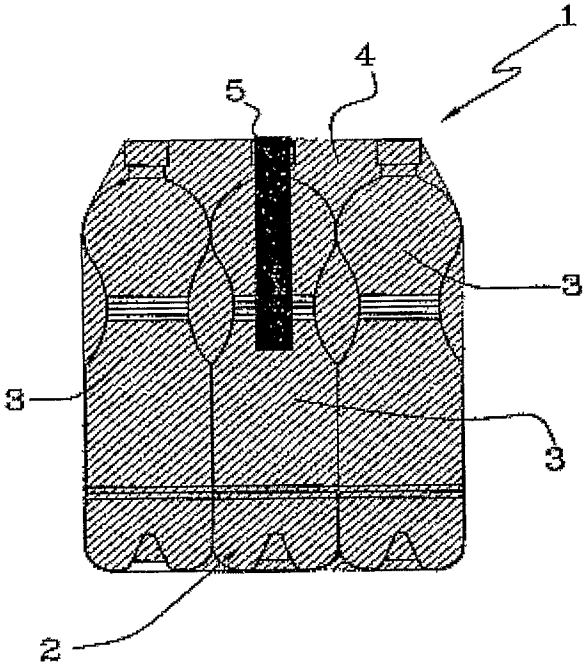
FIG. 1 is a front view of a bundle of containers for liquid food products, in particular bottles of water and/or beverages, packaged by an apparatus according to the present invention.
Figures 4, 5, 6, 7:
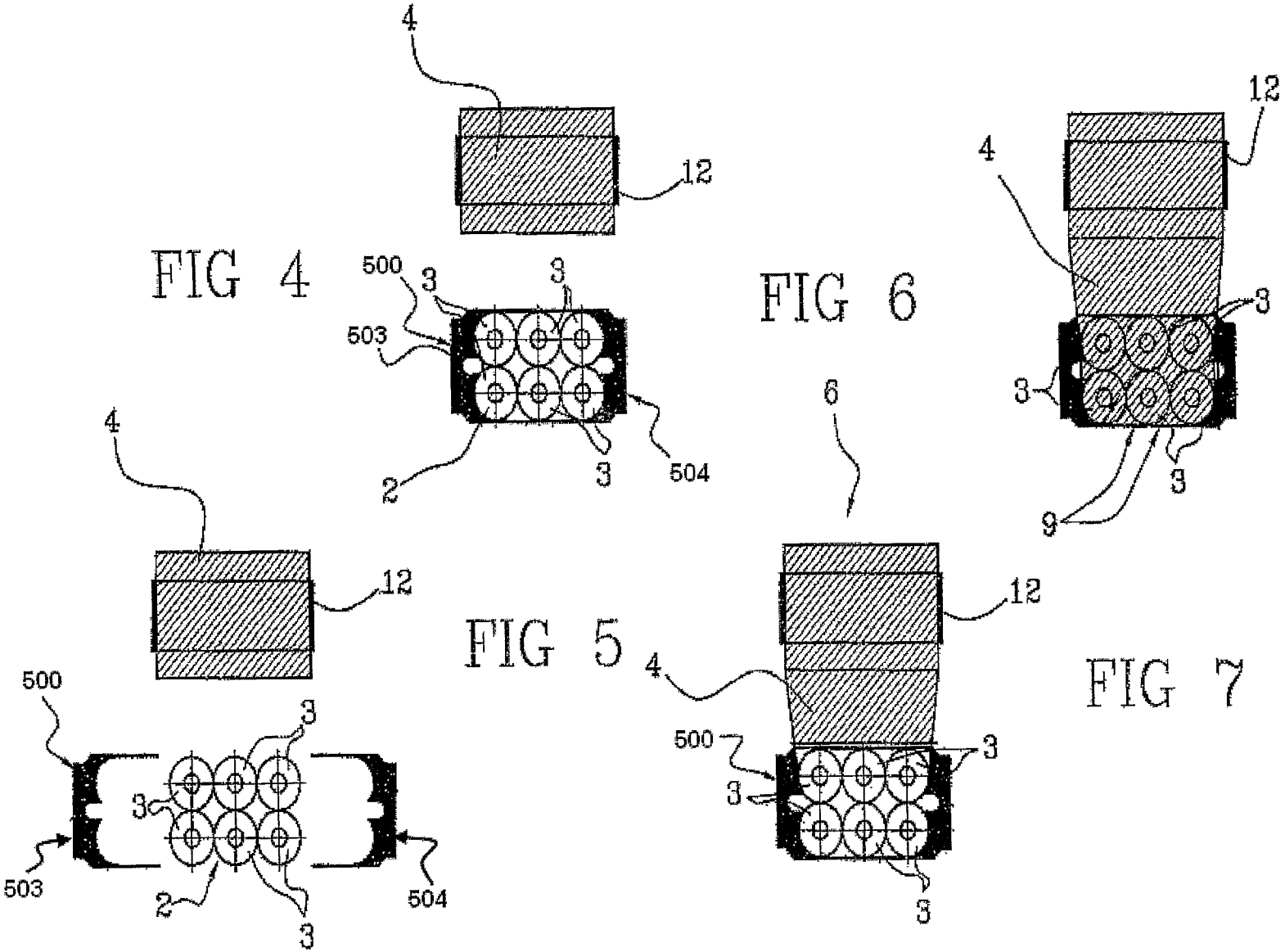
FIG. 4 is a schematisation from above of a first step of the formation of the bundle according to FIGS. 1 to 3.
FIG. 5 is a schematisation from above of a second step of the formation of the bundle according to FIGS. 1 to 3.
FIG. 6 is a schematisation from above of a third step of the formation of the bundle according to FIGS. 1 to 3.
FIG. 7 is a schematisation from above of a fourth step of the formation of the bundle according to FIGS. 1 to 3.
Figure 9:
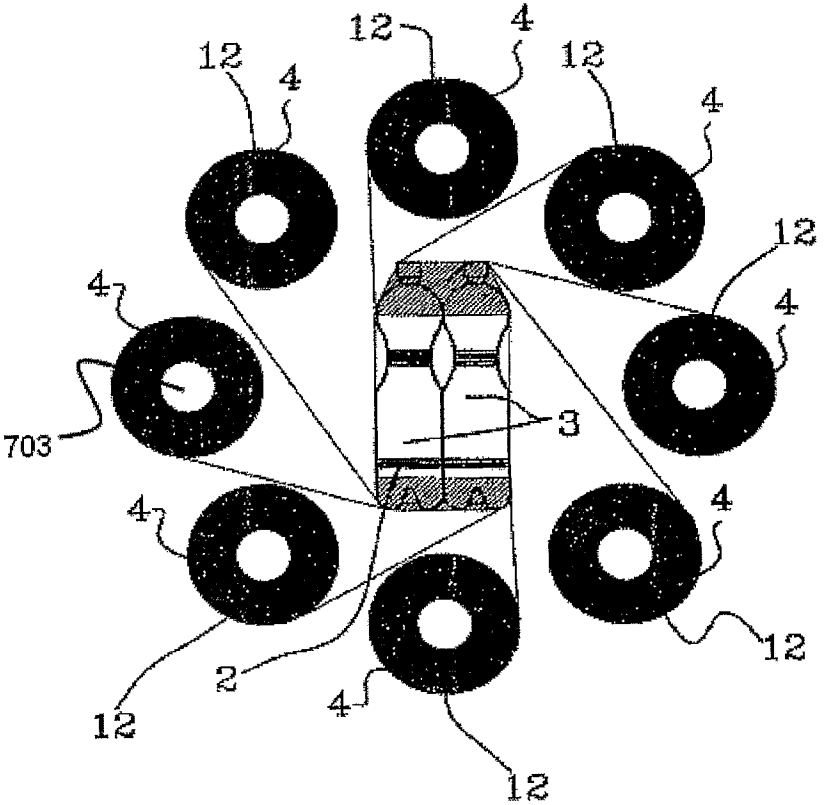
FIG. 9 is a schematisation of the wrapping station illustrated in FIG. 8, during the performance of the fourth step represented in FIG. 7.
Figure 8:
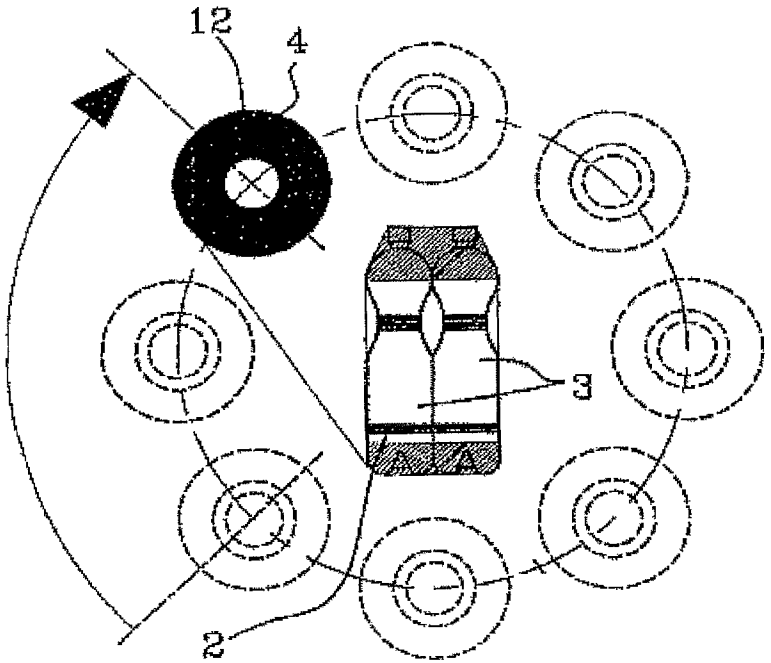
FIG. 8 is a schematisation of a wrapping station during the performance of the third step illustrated in FIG. 6.
Figure 12:
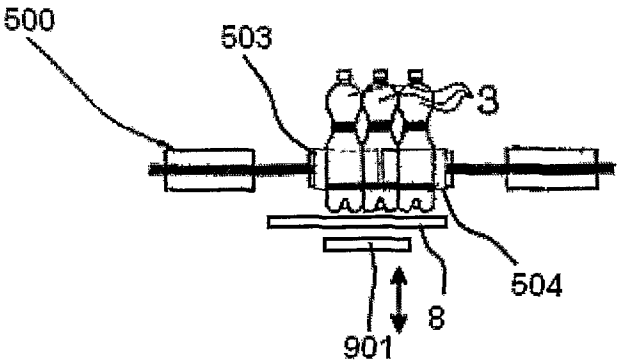
FIG. 12 is an elevated schematic representation of an action of clamping the containers loaded into the wrapping station illustrated in FIGS. 8 and 9.
Figure 11:
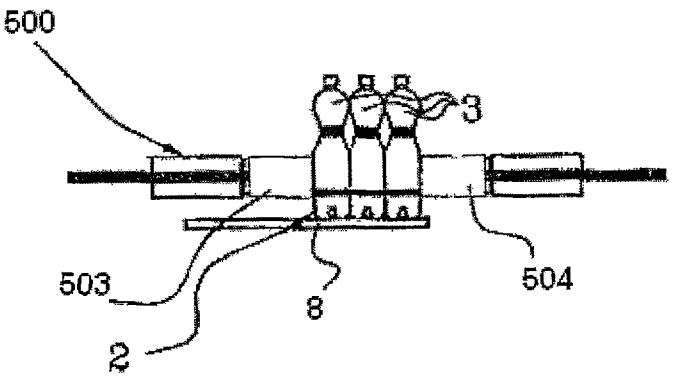
FIG. 11 is an elevated schematic representation of a second action of loading the containers to the wrapping station illustrated in FIGS. 8 and 9.
Figure 10:
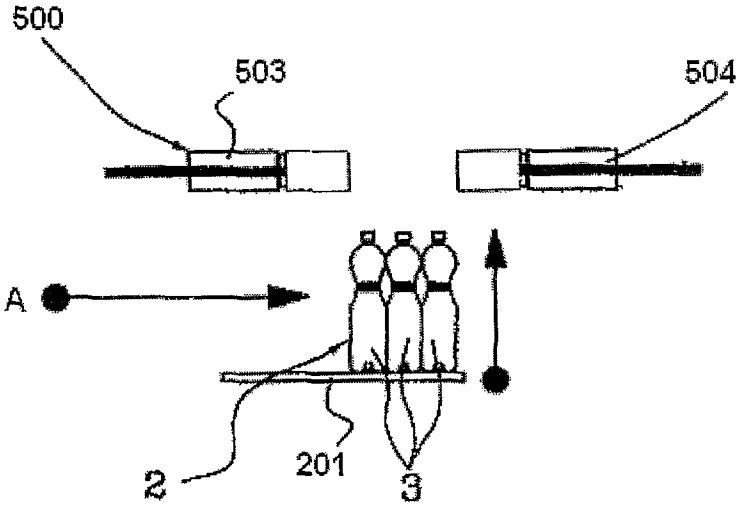
FIG. 10 is an elevated schematic representation of a first action of loading the containers to the wrapping station illustrated in FIGS. 8 and 9.
Figure 15:
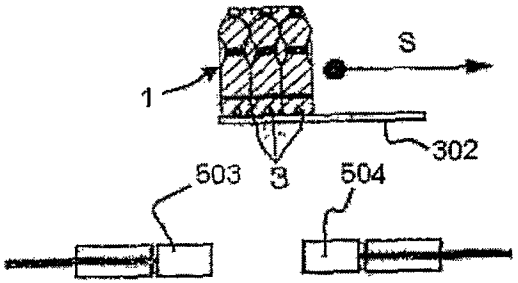
FIG. 15 is an elevated schematic representation of an action of unloading the containers in bundle form.
Figure 14:
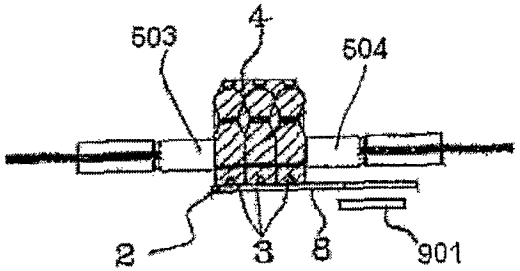
FIG. 14 is an elevated schematic representation of an action of releasing and supporting the containers wrapped by the film of plastic material carried out in the wrapping station illustrated in FIGS. 8 and 9.
Figure 13:
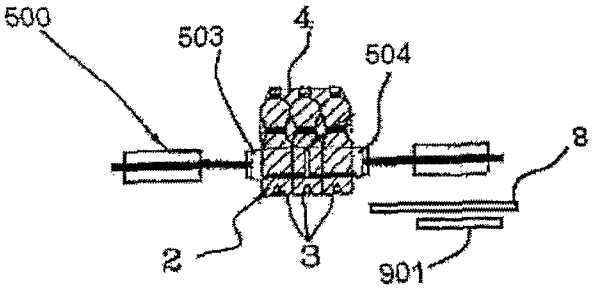
FIG. 13 is an elevated schematic representation of an action of wrapping a film of plastic material around the containers illustrated in FIGS. 7 and 9.

Again, with reference to FIGS. 1 to 3, the bundle 1 can be provided with a suitable handgrip 5, for example made from plastic and/or paper material, engaged at the sides of the bundle 1 and extending astride of the upper part of the latter.

The packaging of the bundles 1 foresees a step of forming at least one group 2 of containers 3 according to the ideal configuration to the formation of the desired type of bundle 1. Thereafter, the film 4 made from plastic material is wrapped around the group 2 of containers 3 formed previously.

The wrapping of the film 4 can vary from a minimum number of revolutions around the group 2 of containers 3, corresponding to one, to a predetermined maximum number of revolutions according to requirements, and more than one. Of course, during the first revolution, the inner surface of the film 4 directly engages the group 2 of containers 3 sticking against the outer surface of the latter, to engage the outer surface of the portion of film 4 already wound on the group 2, from the second revolution.

Preferably, the wrapping of the film 4 of extensible low-density polyethylene (LLDPE) provided with the gluing substance foresees the wrapping of a film 4 in which the gluing substance is present in a percentage of between 10% and 20%, preferably between 13% and 18% per Kg. In this way the sticking of the film 4 to the group 2 of containers 3 is obtained simultaneously.

Figure 16:
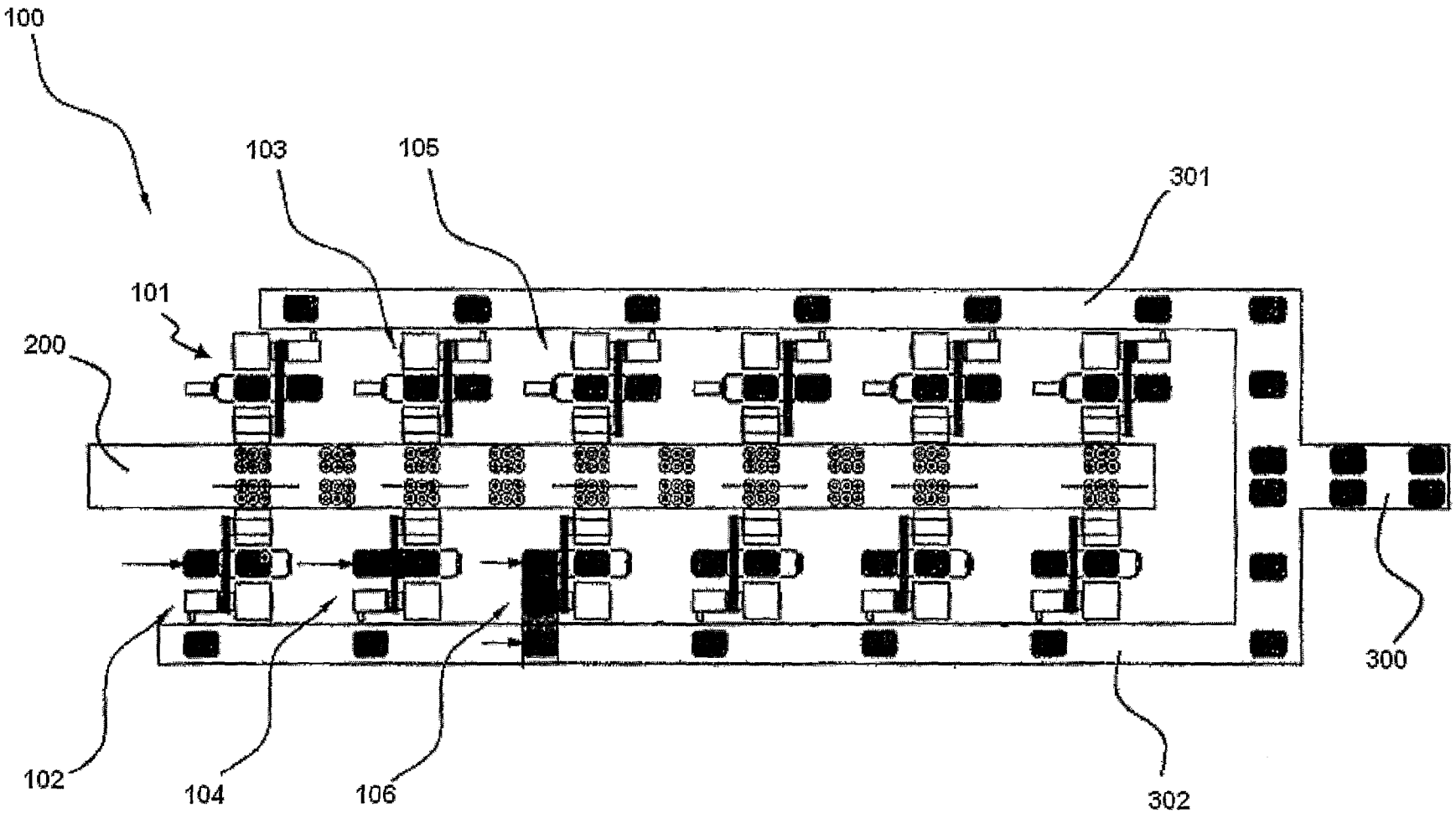
FIG. 16 is a schematic representation from above of an apparatus according to the present invention.
Figure 19:
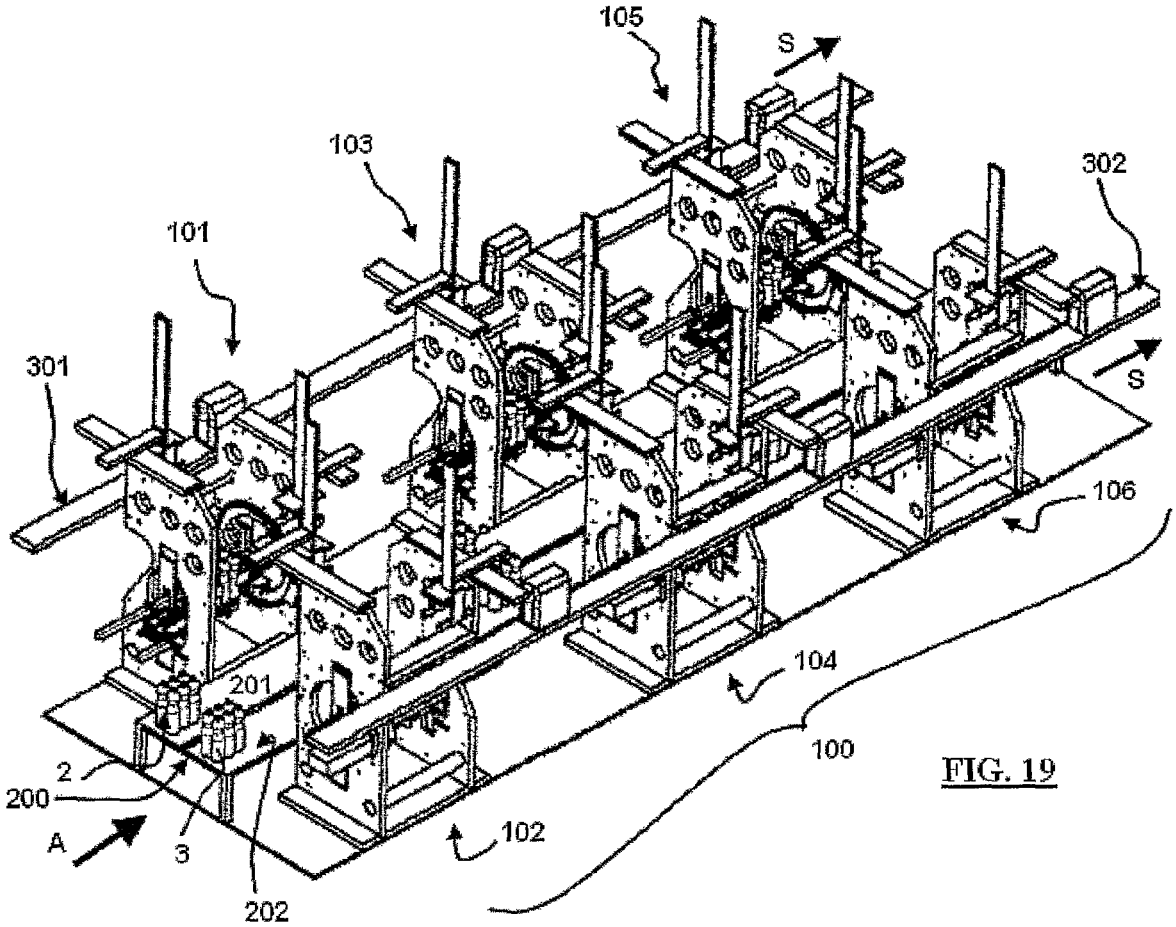
FIG. 19 is a perspective view from above of an apparatus according to the present invention, in a first configuration.

The wrapping of the containers 3 with the film 4 is carried out by means of the apparatus 100 according to the present invention shown in FIG. 19, in perspective, from above and in FIG. 16, in plan.

The apparatus 100 comprises at least one pair of wrapping stations 101, 102, and preferably comprises many pairs of wrapping stations. In the embodiment shown in the attached figures, the apparatus 100 comprises three pairs of wrapping stations 101-102, 103-104, 105-106. Preferably, the wrapping stations of each pair are arranged side-by-side, as shown in FIG. 19.

The apparatus 100 comprises one or more feeding lines 200 of the containers 3, preferably already grouped in groups 2, and one or more discharge lines 300 of the bundles produced. The feeding direction of the groups 2 of containers 3 is indicated with the arrow A and the discharging direction of the bundles is indicated with the arrow S.

In the apparatus 100 shown in FIG. 19 the feeding line 200 is split into two tracks 201 and 202, in practice two parallel conveyor belts, and it is shared between the wrapping stations of all of the pairs 101-102, 103-104, 105-106 of stations. There are two discharge lines, indicated with reference numerals 301 and 302, parallel to the feeding line 200; in practice they are conveyor belts 301, 302 that extend outside of the wrapping stations 101-106.

Figure 20:
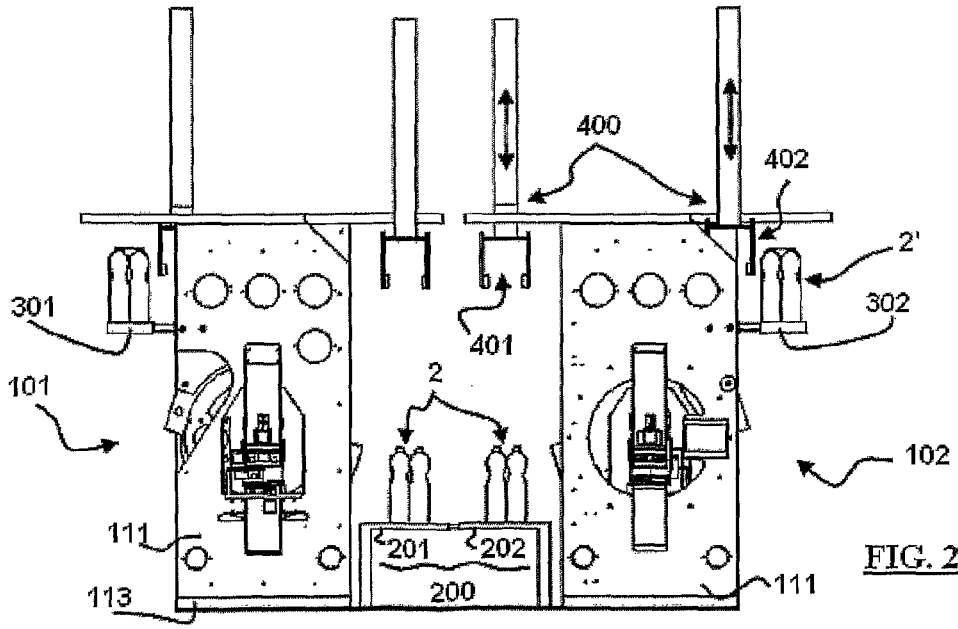
FIG. 20 is a front view of the apparatus shown in FIG. 19.

FIG. 20 is a front view of the apparatus 100, as visible in the direction of the arrow A of FIG. 19. Just the wrapping stations 101, 102 of the first pair of stations are visible; the other stations 103-106 are aligned with them and therefore are not visible. The groups 2 of bottles 3 to be packaged in bundles are fed by the conveyor belts 201 and 202 of the line 200 centrally with respect to the two stations 101 and 102. The bundles 1 are discharged laterally from each station 101, 102 onto the respective conveyor belts 301, 302 that are at a greater height than the conveyor belts 201, 202 with respect to the floor.

Advantageously, the described layout makes it possible to maximise the productivity of the apparatus 100. In the circumstance in which one of the wrapping stations 101-106 stops, due to a failure or to replace a reel of film 4, the remaining wrapping stations continue to be fed by the line 200 and to discharge the bundles 1 onto the discharge lines 301, 302.

Figure 21:
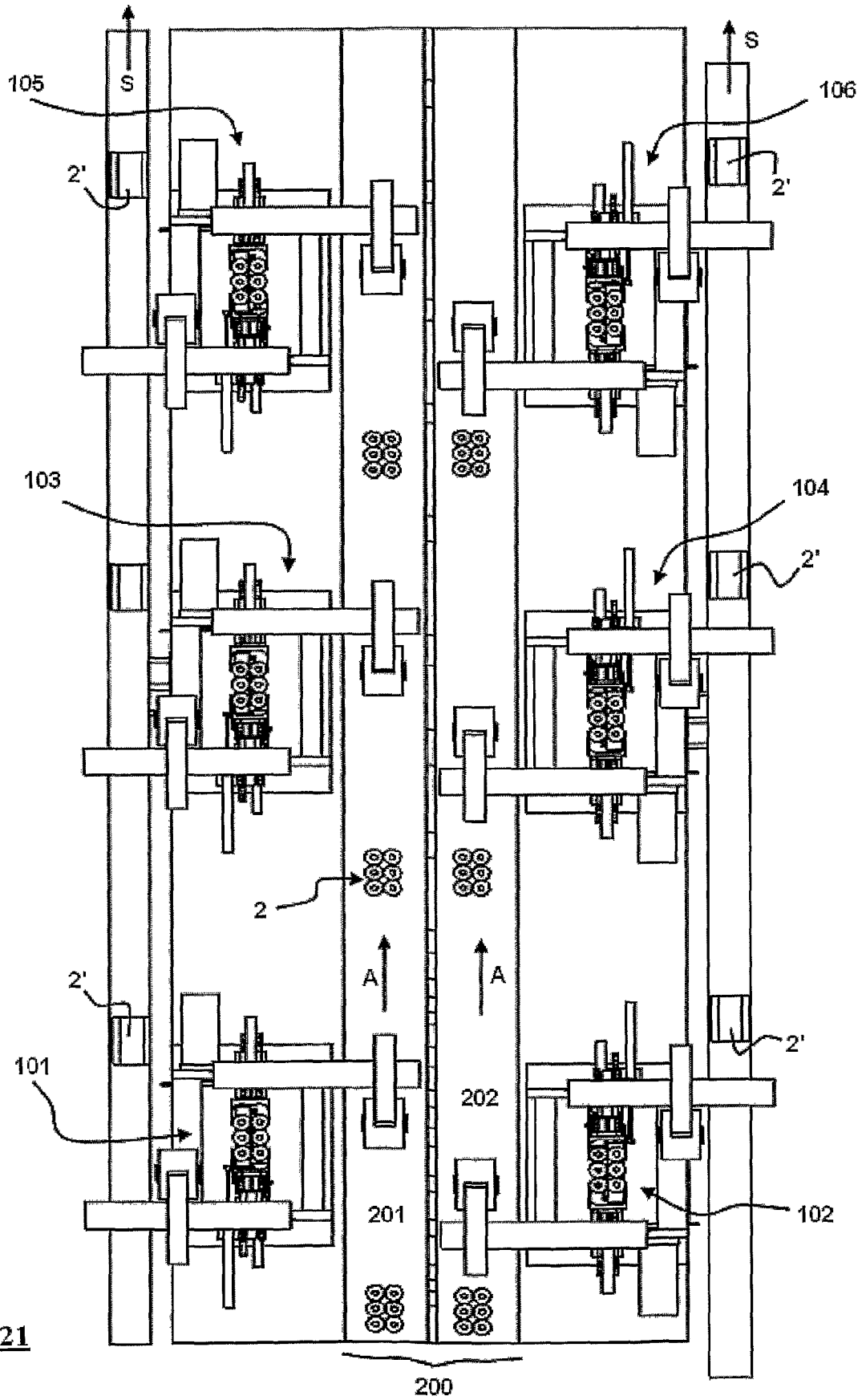
FIG. 21 is a plan view of the apparatus shown in FIG. 19.

FIG. 21 is a plan view of the apparatus 100. As can be seen from observing this figure, the feeding line 200 and the discharge lines 301, 302 are shared between the different wrapping stations 101-106. When the station 101 is engaged in the wrapping of the film 4 over a group 2 of bottles 3, the conveyor belt 201 continues to feed groups 2 of containers 3 to the wrapping stations 103, 105 arranged downstream of the station 101 with respect to the direction A of feeding (or forward movement). Similarly, if for example the wrapping station 104 is busy, the conveyor belt 202 continues to feed the wrapping stations 102 and 106.

Figure 22:
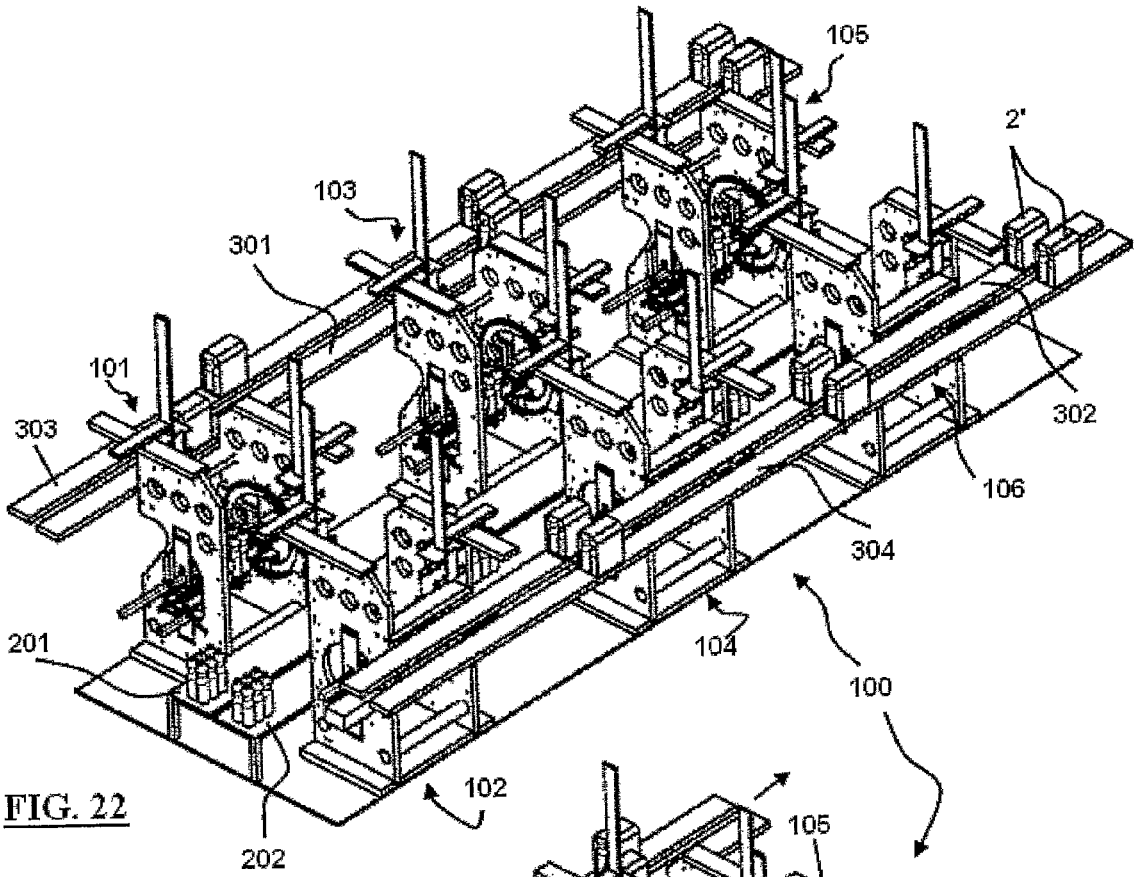
FIG. 22 is a perspective view from above of an apparatus according to the present invention, in a second configuration.
Figure 23:
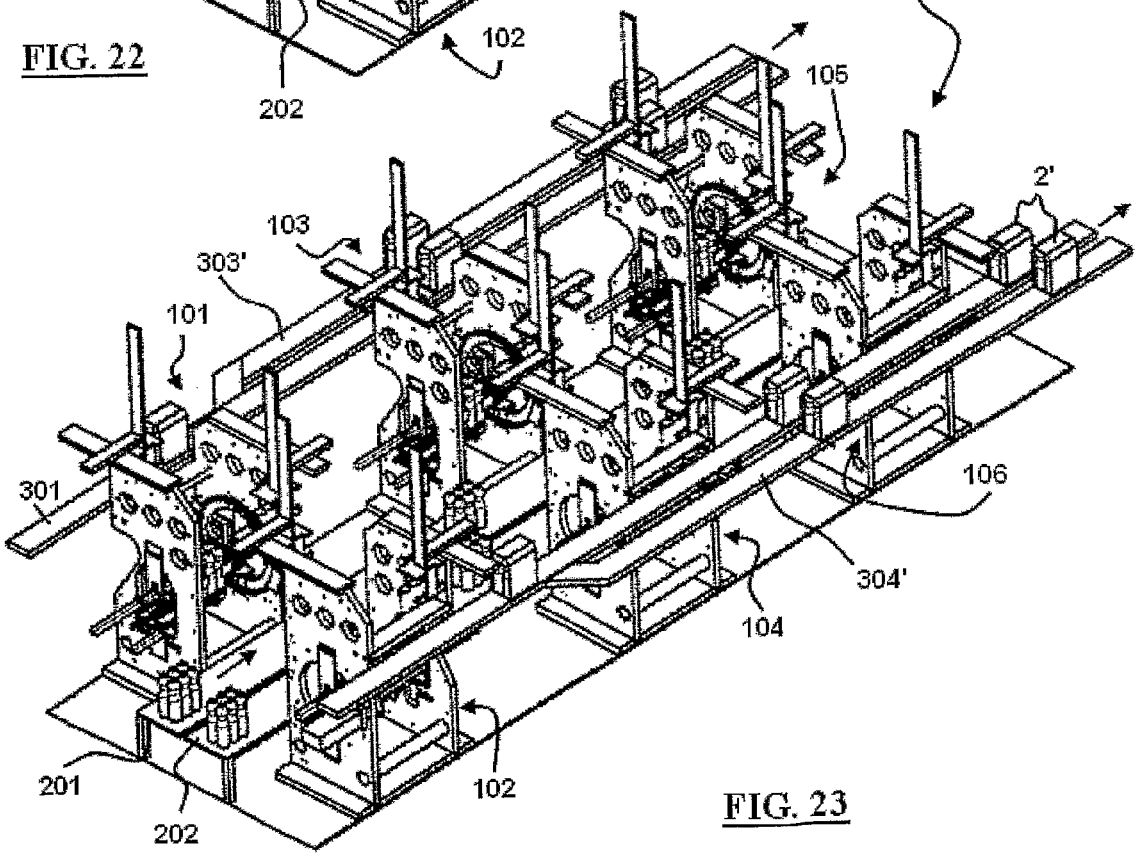
FIG. 23 is a perspective view from above of an apparatus according to the present invention, in a third configuration.

FIGS. 22 and 23 are perspective views, from above, of alternative layouts of the apparatus 100. In particular, the apparatus 100 shown in FIG. 22 comprises all of the elements of the apparatus 100 shown in FIG. 19 and in addition to this two further discharge lines, in practice two further conveyor belts, 303, 304 positioned side-by-side and parallel respectively to the discharge lines 301, 302.

In the layout shown in FIG. 23 the discharge lines 301 and 302 split respectively into the discharge lines 301 and 303', 302 and 304'. The splitting of the discharge lines 301, 302 is arranged between the first and the second pair of wrapping stations 101-102 and 103-104, but it could be downstream of the second pair of wrapping stations 103-104, or downstream of any other pair of stations.

According to the present invention, the feeding line 200 and the discharge lines 301-304, etc., can be inverted, in the sense that the discharge lines can flow together in a single track intermediate between the wrapping stations of the pairs of stations and there can be two or more feeding lines, arranged outside of the wrapping stations.

We will now describe the structure of a wrapping station in general with reference to FIGS. 24-27, and in particular the structure of the gripping and support groups and of the cutting element with reference to FIGS. 28-34.

Figure 24:
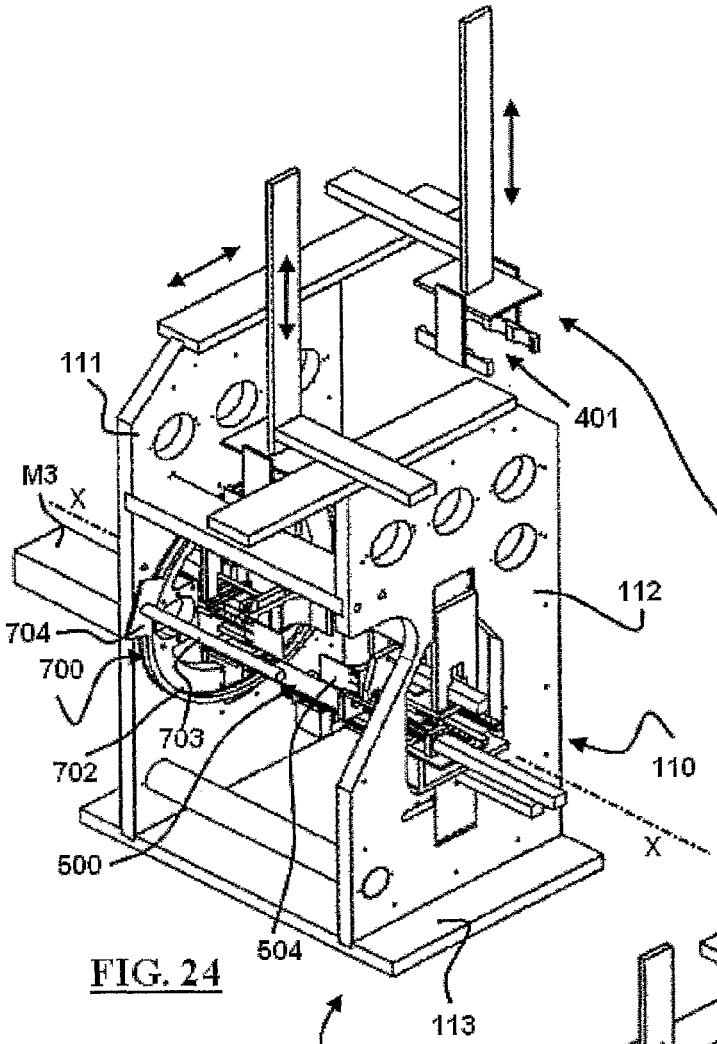
FIG. 24 is a perspective view, on the right hand side, of a detail (wrapping station) of the apparatus shown in FIG. 19.
Figure 25:
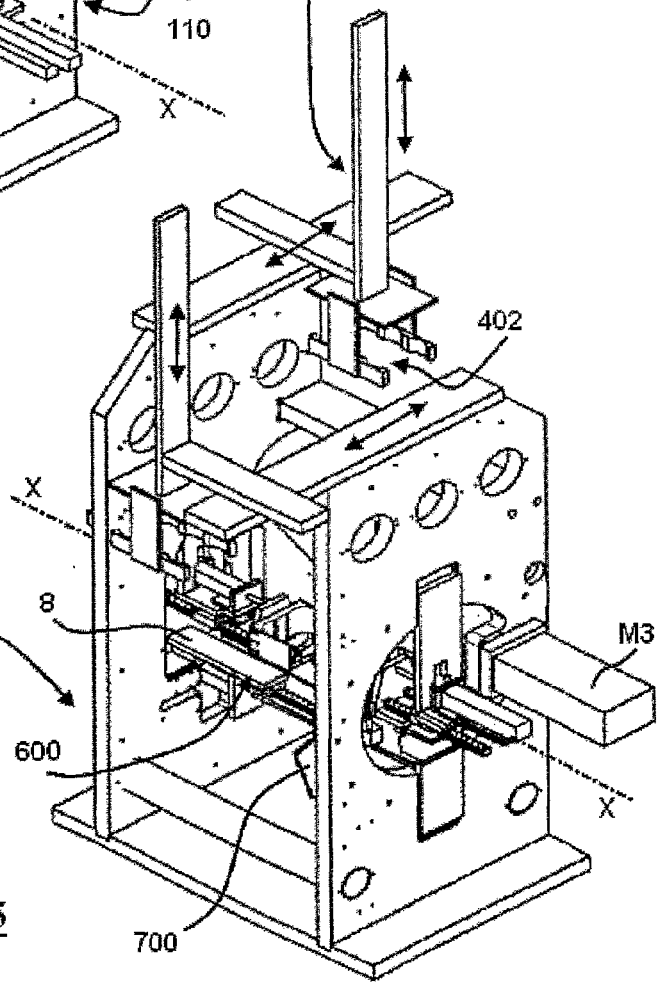
FIG. 25 is a perspective view, on the left hand side, of a detail (wrapping station) of the apparatus shown in FIG. 19.
Figure 26:
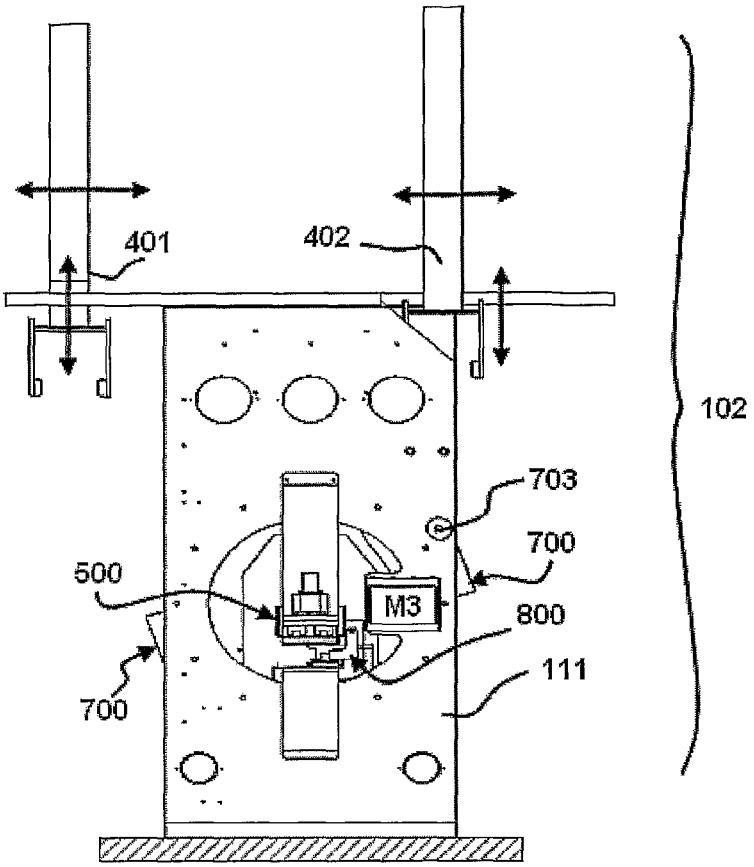
FIG. 26 is a front view of a detail (wrapping station) of the apparatus shown in FIG. 19.
Figure 27:
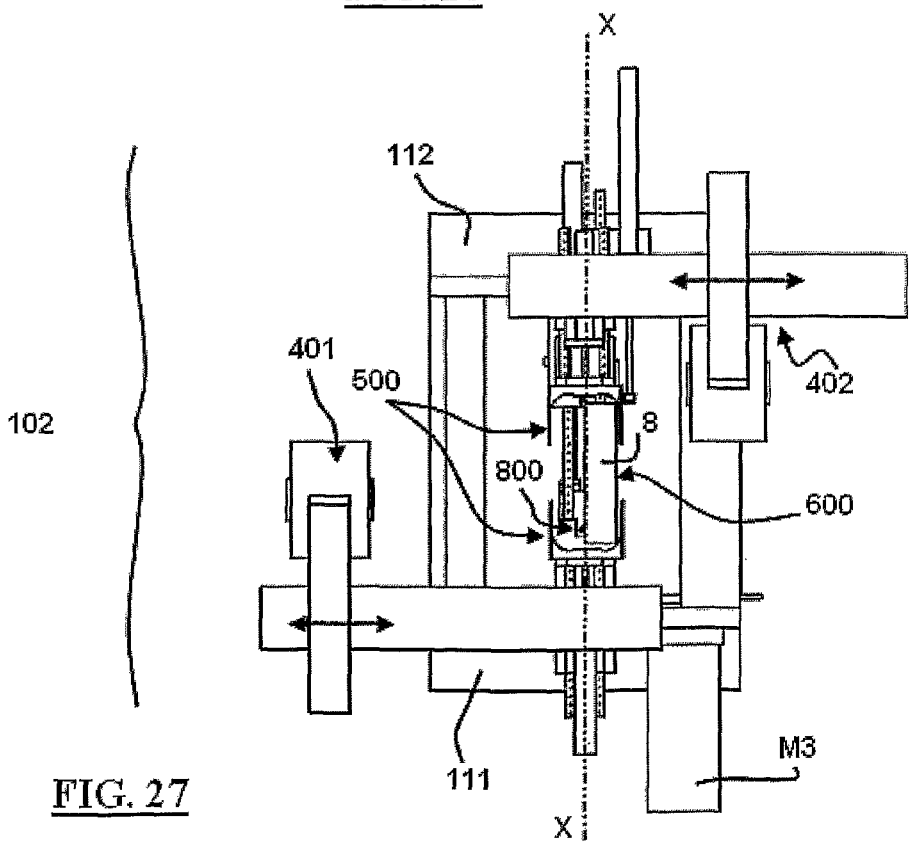
FIG. 27 is a view from above of a detail (wrapping station) of the apparatus shown in FIG. 19.

FIGS. 24 and 25 show in detail the wrapping station 102, respectively in a rear perspective view (opposite direction to the arrow A of FIG. 19) and in a front perspective view (along the direction of the arrow A of FIG. 19). FIGS. 26 and 27 show the wrapping station 102, respectively in a front perspective view (direction of the arrow A of FIG. 19) and in a plan view. The other wrapping stations 101, 103-106 are equivalent, and preferably identical in structure, to the station 102.

With reference to FIGS. 20, 24-27, the station 102 comprises a frame 110 in turn formed from a horizontal base 113, able to be fixed to the floor, and from parallel vertical walls 111 and 112. The vertical walls 111 and 112 support manipulating means 400 of the wrapping station.

The manipulating means 400 comprise a first mechanical arm 401, able to be moved between a first position for picking up the group 2 of containers 3 from the conveyor belt 202 and a second position for delivering the group 2 of containers 3 to the wrapping station 102, and a second mechanical arm 402 able to be moved between a first position for picking up the bundle 1 of containers from the wrapping station 102 and a second position to release the bundle 1 onto the conveyor belt 302 (or 304 or 304').

The mechanical arms 401 and 402 are mobile along two axes as indicated by the relative arrows; in particular, each arm 401, 402 can be moved horizontally with respect to the vertical wall 111 or 112 to be positioned on the vertical of the conveyor belt 202, or on the vertical of the conveyor belt 302, and on the vertical of the wrapping station 102, and it is able to move vertically to go to the correct height with respect to such conveyor belts 202 o 302.

The mechanical arms 401 and 402 shown in the figures are provided with jaws able to be clamped onto the groups of containers 3.

The wrapping station 102 also comprises a gripping group 500, a support group 600, a reel-carrying group 700, an element 800 for cutting the film 4 and a pincer group 900, all at least partially housed between the vertical walls 111 and 112. These elements will now be described in detail with reference to FIGS. 24-34.

With reference to FIGS. 24-26, the reel-carrying group 700 comprises a circular rack 702, in practice an internally toothed wheel provided with a perimetral bracket 704 for supporting the shaft 703 of a reel of film 4. The rack 702 is mounted rotatably, for example on bearings, on the wall 111 of the frame 100 of the wrapping station. The rack 702 is set in rotation around an axis parallel to or coinciding with the longitudinal axis X-X, which as will be described hereafter is the axis of the gripping group, by a motor M3 the shaft of which is provided with an externally toothed wheel that engages with the toothing of the rack 701. The rotation of the shaft of the motor M3 therefore causes the rotation of the rack 702 with respect to the wall 111 and, consequently, it causes the rotation of the reel-carrying bracket 704 around the longitudinal axis X-X.

Figure 28:
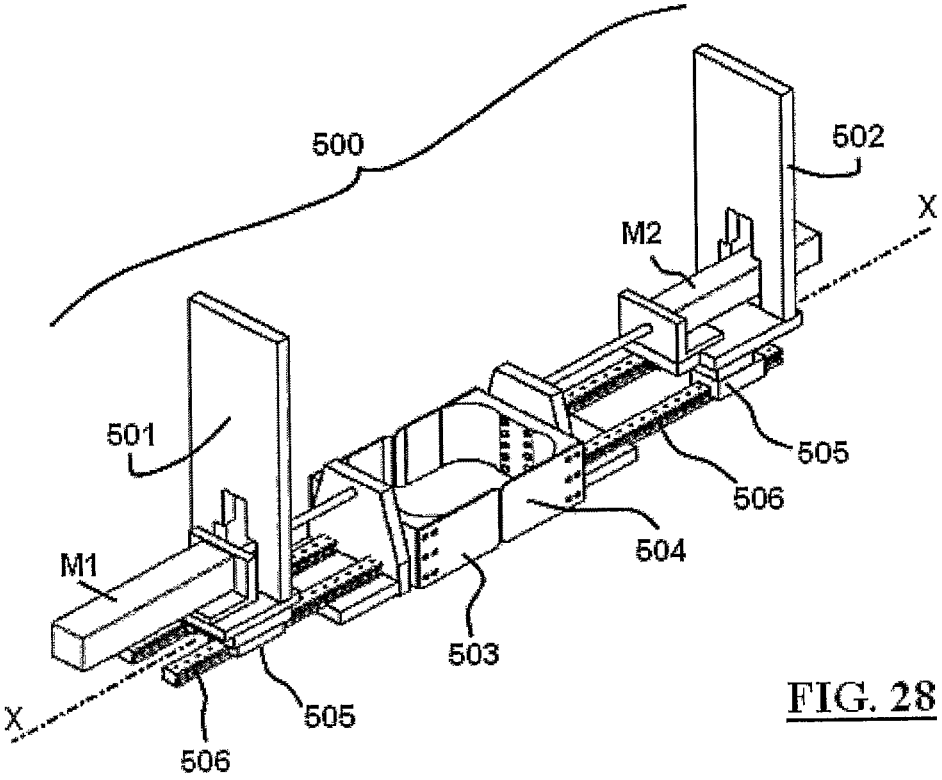
FIG. 28 is a perspective view of a detail (gripping group) of the apparatus shown in FIG. 19.

FIG. 28 shows a perspective view of the gripping group 500, which in general comprises two U-shaped jaws 503 and 504, able to move one against the other along a longitudinal axis X-X to laterally clamp a group 2 of containers 3 and hold them in the vertical position without engaging its upper portion and lower portion.

In FIG. 28 the gripping group 500 is shown in its closed configuration, i.e. with the jaws 503 and 504 in head-to-head abutment (in general the jaws may not touch one another). The bottles 3 have been omitted for the sake of greater clarity. The man skilled in the art will understand that the jaws 503 and 504 can have a different shape to the one indicated, provided that they do not prevent access to the upper portion (the neck and the cap) and lower portion (the bottom) of all of the bottles 3.

The alternate translating movement of the jaws 503 and 504 is controlled by respective motors M1 and M2 acting on pads 506 fixed to the jaws 503 and 504 and able to slide in corresponding guides formed in the support brackets 501 and 502, which in turn are fixedly connected to the walls 111 and 112 of the wrapping station 102. Preferably, the jaws 503 and 504 are adjustable, i.e. the relative position can be modified with precision, perpendicularly to the longitudinal axis X-X, both vertically and horizontally.

The opening of the gripping group 500 corresponds to a pulling back of the jaws 503 and 504 along the longitudinal axis X-X.

Figure 29:
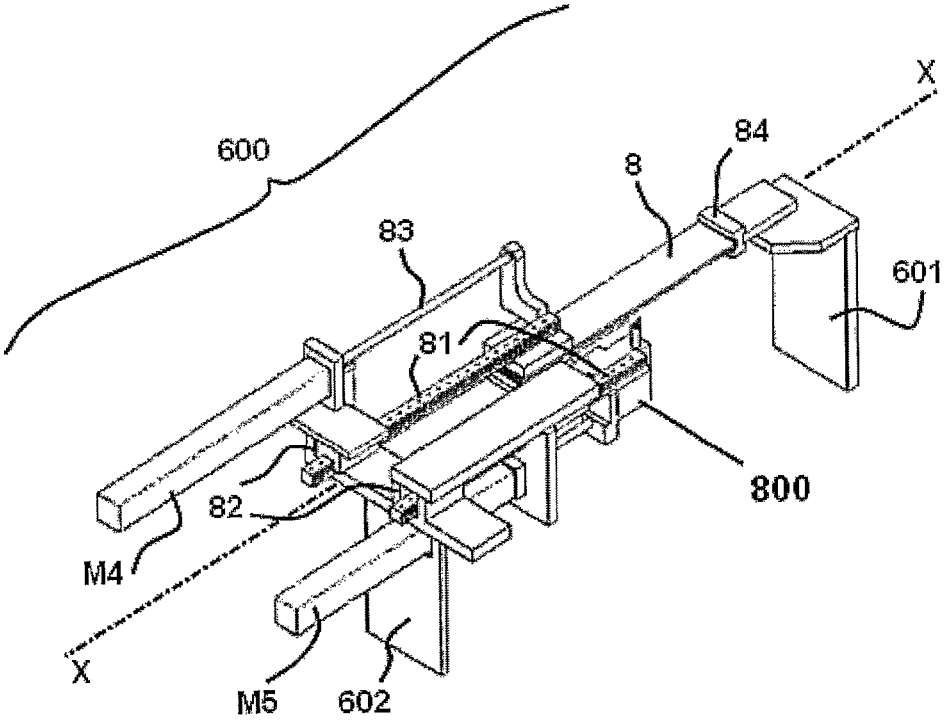
FIG. 29 is a perspective view of a detail (support group and cutting element) of the apparatus shown in FIG. 19.

FIG. 29 shows a perspective view of the support group 600, which in general comprises a horizontal plate, or tray, 8 able to move parallel to the longitudinal axis X-X of the gripping group 500 between a first retracted position, at which the plate 8 does not support the group 2 of containers 3, and an extended position, at which the plate 8 is in abutment against an abutment surface 84 and directly supports the bottom of some containers 3. The plate 8 is translated alternately along the axis X-X by the motor M4 that thrusts the relative shaft 83 and causes the sliding of the pads 81 of the plate 8 in the corresponding fixed guides 82. The support group 600 is fixed to the side walls 111 and 112 of the frame 100 of the wrapping station respectively by means of the brackets 601 and 602.

The support group 600 has the function of supporting the containers of the group fed to the wrapping station when the gripping group 500 is not operative, i.e. when the jaws 503 and 504 are retracted and distant, as shown in FIGS. 24, 25 and 27.

Figure 32:
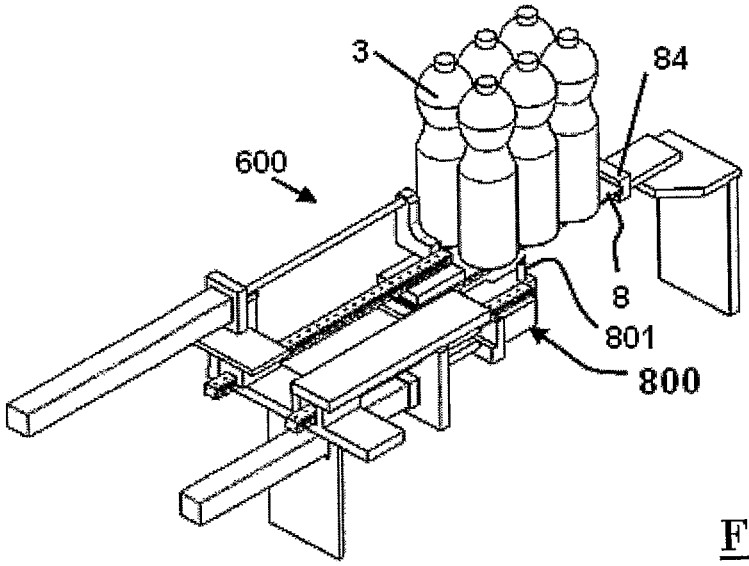
FIG. 32 is a perspective view from above of a detail (support group and cutting element) of the apparatus shown in FIG. 19.
Figure 33:
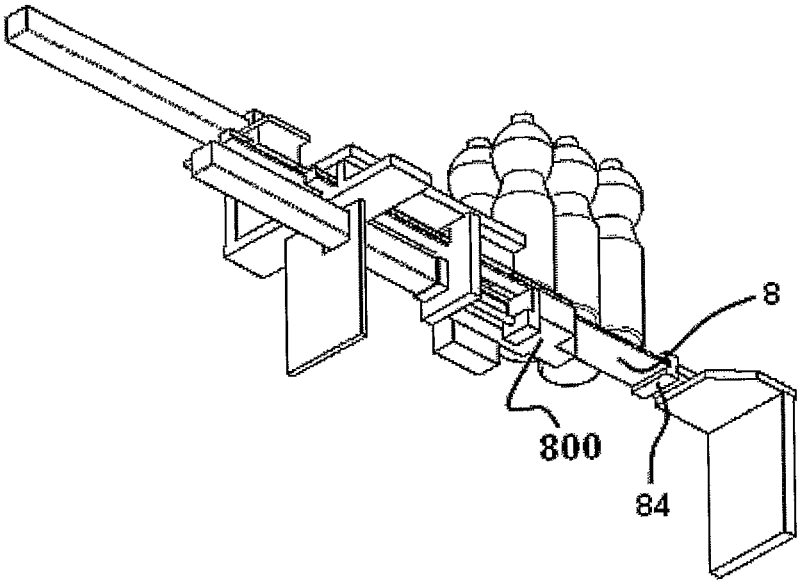
FIG. 33 is a perspective view from below of a detail (support group and cutting element) of the apparatus shown in FIG. 19.

FIGS. 32 and 33 show perspective views, respectively from above and below, of the support group 600 while operating, with the support plate 8 completely extended and in abutment against the abutment surface 84. The plate 8 directly supports some of the bottles 3. In the same figures it is possible to see the element 800 for cutting the film 4.

Figure 30:
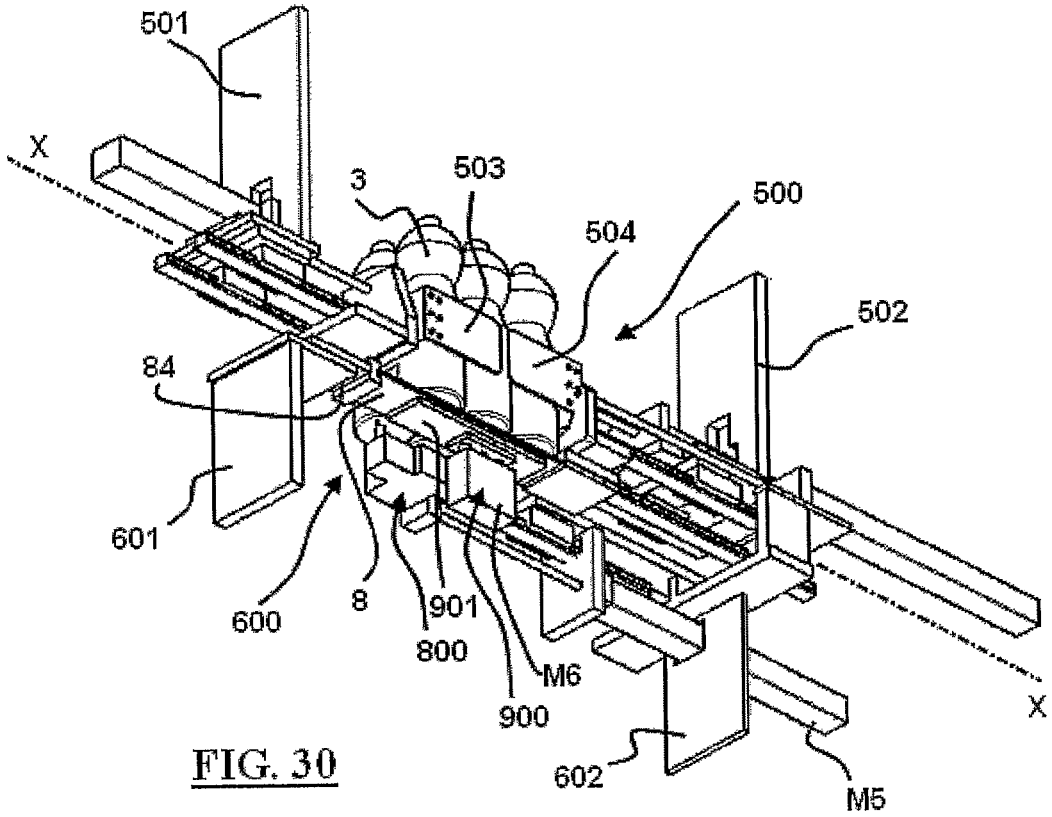
FIG. 30 is a perspective view from below of a detail (gripping group and support group) of the apparatus shown in FIG. 19.
Figure 31:
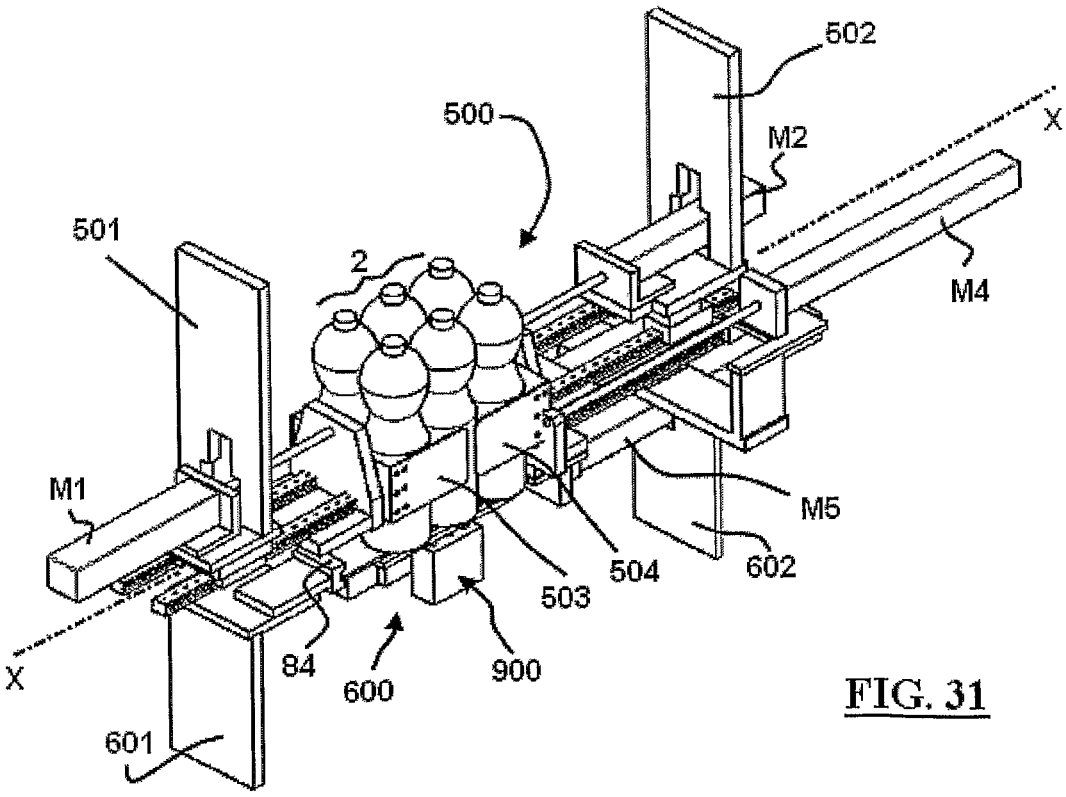
FIG. 31 is a perspective view from above of a detail (gripping group, support group and pincer group) of the apparatus shown in FIG. 19.
Figure 34:
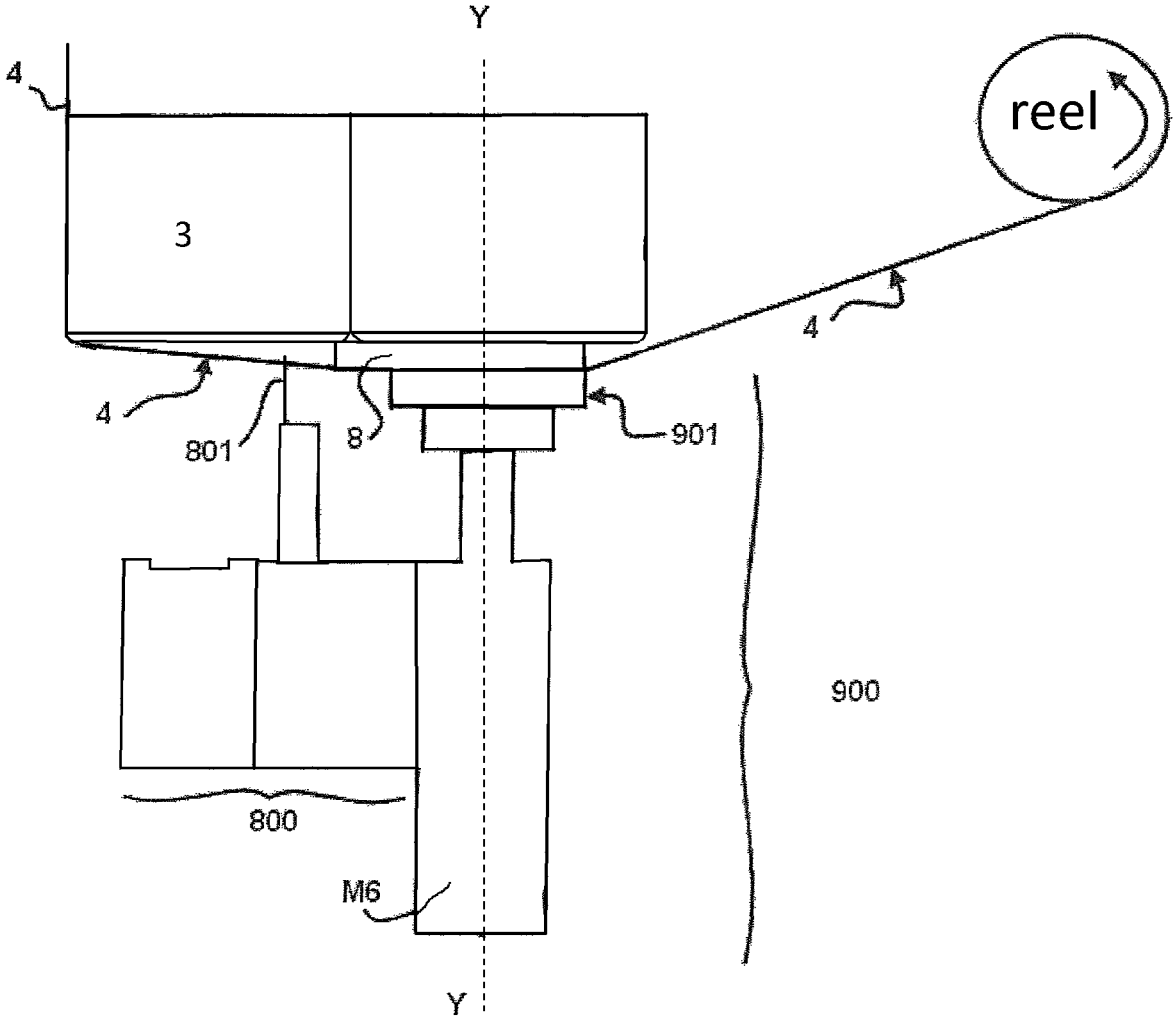
FIG. 34 is an elevated view of a detail (cutting element and pincer group) of the apparatus shown in FIG. 19.

The cutting element 800, also visible in FIGS. 30 and 34, comprises a knife 801 able to translate parallel to the longitudinal axis X-X (which is also parallel to, or coinciding with, the rotation axis of the reel-carrying group 700), substantially alongside the support plate 8. The actuation of the cutting element 800 is controlled by the motor M5 in a similar way to what has been seen for the other groups of the wrapping station.

The pincer group 900 is clearly visible in FIGS. 30 and 34. Such a group comprises a motor M6 and a jaw 901 connected to it. The jaw 901 is able to translate vertically along the axis Y-Y, perpendicular to the longitudinal axis X-X, to lock the film 4 against the lower surface of the support plate 8.

The pincer group 900 is also able to translate alternately along a direction parallel to the axis X-X to follow the plate 8 when it goes into its extended position. In order to obtain this, preferably the pincer group 900 is provided with its own motor and guides.

With reference to all of the figure and in particular to FIGS. 4 to 15, the step of wrapping the group 2 of containers 3 shall now be described.

When the group 2 of containers 3, previously formed, is brought from the feeding line 200 to a loading area adjacent to the wrapping station 102, the mechanical arm 401 transfers the group 2 to the gripping group 500 and to the support group 600 that cooperate to correctly position the group 2 of containers 3 with respect to the film 4 to be wound, i.e. with respect to a reel of film 4. The support plate 8 of the support group 600 is completely extended, as shown in FIGS. 32 and 33, and together with the manipulator 401, supports the group 2 of bottles against falling.

A reel 12 of film 4 is loaded onto the shaft 703, which in turn is engaged canti-levered in the bracket 704 of the reel-carrying group 700. The strip of film 4, partially unwound from the reel 12, has a free edge that is locked between the support plate 8 and the jaw 901 of the pincer group 900.

At this point the jaws 503 and 504 of the gripping group close onto the group 2 of bottles 3, as shown in FIGS. 4-5, 10-12 and 30-31. In such a position, the jaws 503 and 504 press the containers 3 so as to create a compact core. The manipulator 401 completes a return stroke to pick up a new group of bottles 3 to be packaged from the feeding line 200.

Then the step of wrapping the film 4 made from extensible low-density polyethylene (LLDPE) described above begins.

The motor M3 of the reel-carrying group activates to rotate the rack 702 around the longitudinal axis X-X of the gripping group. Consequently, the reel 12 of film 4 rotates around the group 2 of bottles 3 held by the gripping group 500 (FIGS. 6-9, 17). The film 4 unwinds onto the group 2 of bottles and onto the jaws of the gripping group.

Figure 18:
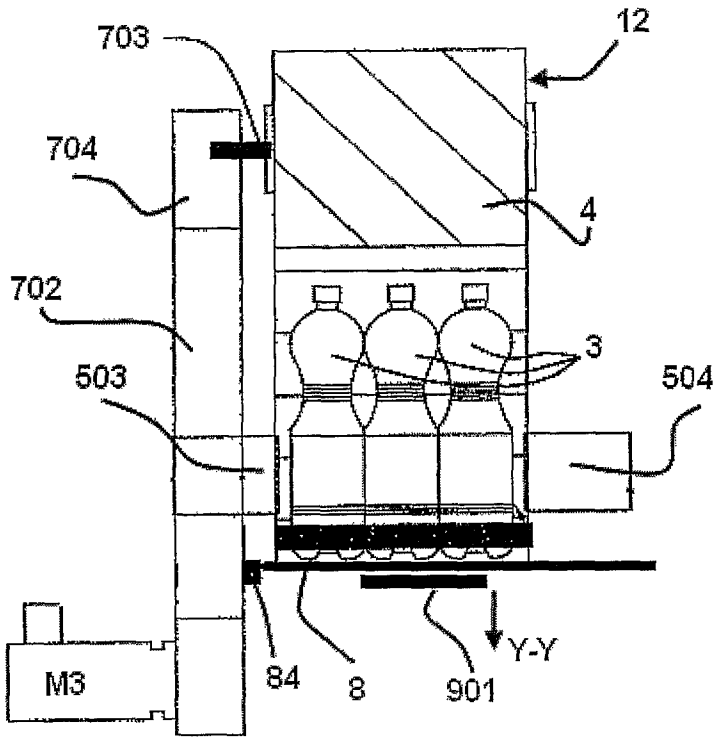
FIG. 18 is an elevated schematic representation of the wrapping stations of the system according to FIGS. 16 and 17.

Before the first revolution of the circular rack 702 is completed, and therefore before the film 4 has completely wrapped the group 2 of bottles 3, the pincer group 900 is deactivated, i.e. the jaw 901 is lowered along the axis Y-Y, separating from the support plate 8 and freeing the film 4 (FIG. 18). The entire pincer group 900 is retracted towards the plate 602 shown in FIG. 30, freeing the area underneath the plate 8 (see also FIGS. 12 and 29). The pincer group and the cutting element can be activated simultaneously or at different times, for example the cutting element can be activated a little after the pincer group.

In this circumstance the film 4 has already stuck to at least part of three of the six bottles 3 of the group 2 and although it is no longer held by the pincer group 900, it does not disengage from the bottles 3.

Figure 17:
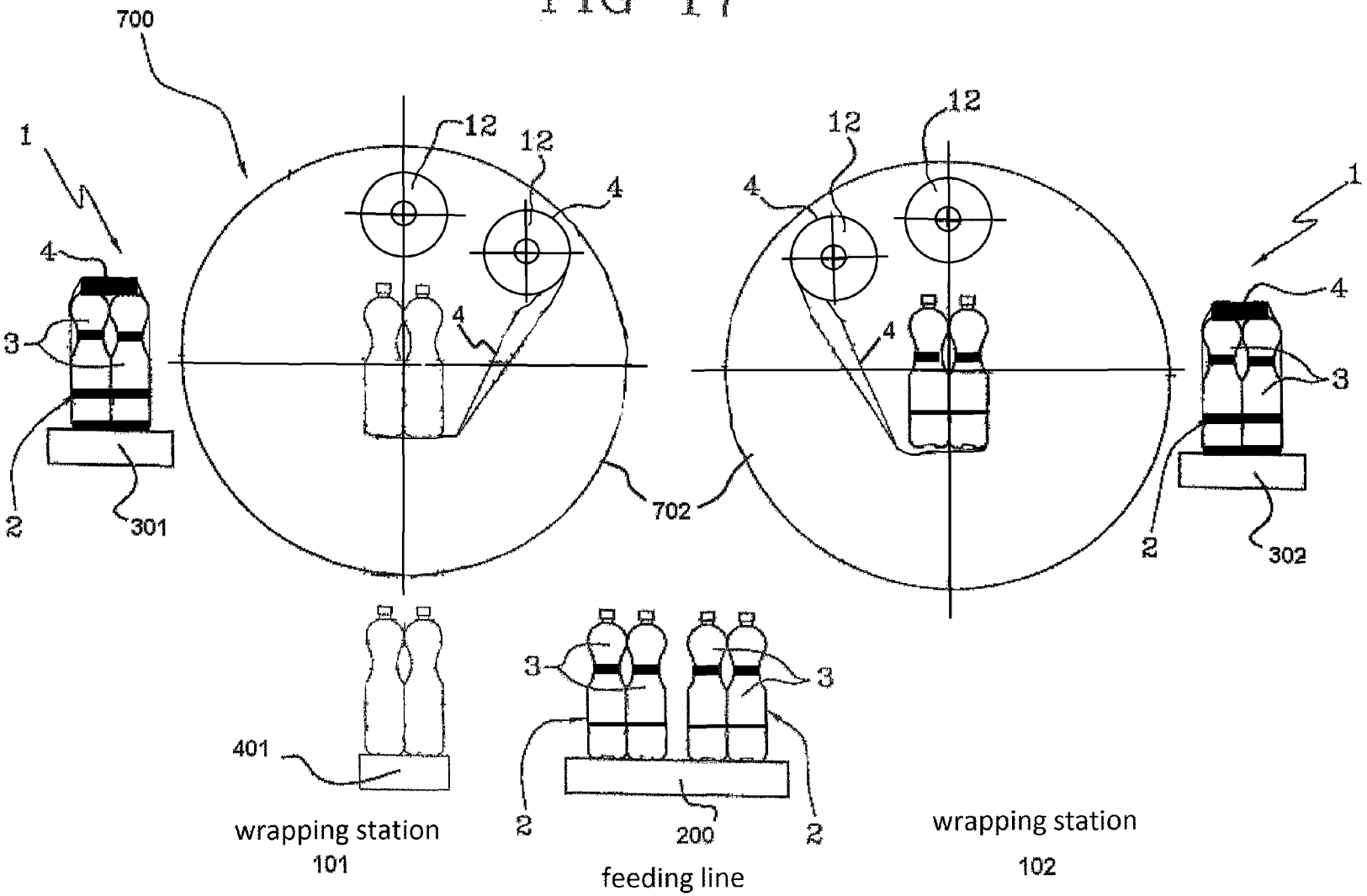
FIG. 17 is a schematic front view of the system according to FIG. 16.

The support plate 8 is now retracted (FIG. 13) to allow the bottles 3 to be completely wrapped. Almost simultaneously the circular rack 702 and the reel 12 of film 4 perform many revolutions around the group 2 of bottles 3 (FIG. 17). Preferably, the film 4 is wrapped three times over the group 2 of bottles 3.

Upon completion of the penultimate revolution of the reel 12, the support plate 8 is brought back into the extended position (FIG. 14), in abutment against the surface 84, to support from below the bundle 1 being completed.

At the end of the last revolution, the pincer group 900 is brought under the support plate 8 and activated to lock the film against the same plate 8.

The pincer group 900 us also activated to go beneath the support plate 8 and lock the film 4 against the plate 8 (FIG. 34).

The cutting element 800 is activated as shown in FIG. 34, translating the knife 801 parallel to the longitudinal axis X-X of the gripping group 500, alongside the support plate 8, to cut the strip of film 4.

A first edge of the strip stays locked in the pincer group 800, ready for the packaging of a new group 2 of bottles 3; the second edge sticks to the bundle 1 already formed.

The jaws 503 and 504 of the gripping group 500 open to free the formed bundle 1. In this step the jaws 503 and 504 slide between the bottles 3 and the layers of film 4 wound onto them.

The second manipulating arm 402 of the manipulating means 400 picks up the bundle 1 and delivers it to the discharge line 302, or 304 (FIG. 16).

The operation of the wrapping station 102 repeats for the packaging of a new group 2 of bottles 3.

The operation of the other wrapping stations 101, 103-106 is analogous to that just described.

The invention claimed is:

1. Apparatus for packaging containers for liquids into bundles, comprising:

at least one pair of wrapping stations for groups of containers, each station in turn comprising means for wrapping an extensible film around a group of containers and manipulating means for feeding and discharging said groups of containers to/from the wrapping station;

at least one feeding line of the containers to be packaged;

at least one discharging line of the containers packaged into bundles;

wherein a feeding line is intermediate with respect to the wrapping stations of each pair of wrapping stations and wherein there are at least two discharge lines, each of which is opposite said feeding line with respect to the corresponding wrapping station or, vice-versa, a discharge line is intermediate with respect to the wrapping stations of each pair of wrapping stations and wherein there are at least two feeding lines, each of which is opposite said discharge line with respect to the corresponding wrapping station.

2. Apparatus according to claim 1, wherein said feeding lines extend substantially at the same height with respect to said discharge lines or else at different heights.

3. Apparatus according to claim 1, wherein each of said feeding lines and said discharge lines is a single track or is split into many tracks.

4. Apparatus according to claim 1, wherein each of said feeding lines and discharge lines comprises at least one conveyor belt, or else many conveyor belts in series and/or in parallel.

5. Apparatus according to claim 1, wherein each wrapping station comprises a gripping group of a group of containers to be packaged into bundles, and said manipulating means comprise:

a first mechanical arm, able to be moved between a first position for picking up the group of containers from said at least one feeding line and a second position for delivering the group of containers to said gripping group, and a second mechanical arm able to be moved between a first position for picking up the bundle of containers from said gripping group and a second position for releasing the bundle of containers onto a discharge line.

6. Apparatus according to claim 5, wherein said gripping group comprises at least two U-shaped jaws, able to be moved one against the other along a longitudinal axis to laterally clamp said group of containers and hold them vertically against falling.

7. Apparatus according to claim 6, wherein said means for wrapping a film around a group of containers comprise a reel-carrying group, suitable for horizontally supporting a reel of the film, wherein said reel-carrying group is rotatable around said longitudinal axis of the gripping group.

8. Apparatus according to claim 7, wherein said reel-carrying group comprises:

a bracket for supporting a shaft of a reel of the film and an internally toothed wheel, the rotation axis of which coincides with the longitudinal axis of the gripping group, said bracket being integral with, or fixed to, said internally toothed wheel.

9. Apparatus according to claim 8, also comprising actuator means of said reel-carrying group, said actuator means in turn comprising an electric motor and an externally toothed wheel, fitted onto the shaft of the electric motor and directly engaged with said internally toothed wheel.

10. Apparatus according to claim 6, also comprising a group for supporting said group of containers, said support group in turn comprising:

a horizontal plate able to move parallel to the longitudinal axis of said gripping group between a first retracted position, at which said horizontal plate does not support the group of containers, and an extended position, at which said horizontal plate supports the base of said containers clamped in the gripping group, an abutment surface of said horizontal plate in extended position, and actuator means of said horizontal plate.

11. Apparatus according to claim 10, also comprising a pincer group suitable for locking a portion of said film at the group of containers, the pincer group comprising:

a jaw, able to be moved in abutment against said horizontal plate of the support group to lock the film and prevent it from sliding, and actuator means of said jaw suitable for thrusting it, along said longitudinal axis X-X, under the horizontal plate of the support group in extended position, and actuator means of said jaw suitable for thrusting it against the horizontal plate of the support group in extended position.

12. Apparatus according to claim 6, also comprising a cutting element for cutting the film able to be moved parallel to the longitudinal axis of the gripping group, near to a lower perimeter of the bundle in formation.

13. Apparatus according to claim 12, wherein said cutting element is fixedly connected to said pincer group and/or to a support plate, or else it is independent from them and is equipped with its own actuator means suitable for driving its movement in the longitudinal direction.

14. Apparatus for packaging containers for liquids, comprising at least one station for wrapping groups of containers in bundles, the station in turn comprising:

a gripping group comprising at least two U-shaped jaws, able to move one against the other along a longitudinal axis to laterally clamp a group of containers and hold them vertically without engaging an upper portion and lower portion thereof;

means for wrapping an extensible film around the group of containers held by the gripping group, a wrapping direction of the film being circumferential with respect to the longitudinal axis of the gripping group; and an element for cutting the film, able to move parallel to the longitudinal axis of the gripping group, near to a lower perimeter of the bundle in formation, to separate the part of the film wound on the bundle of containers from a remaining part of film.

15. Apparatus according to claim 14, also comprising a group for supporting said group of containers, the support group in turn comprising a horizontal plate able to move parallel to the longitudinal axis of said gripping group between a first retracted position, at which said horizontal plate does not support the group of containers, and an extended position, at which said horizontal plate supports at a bottom at least some of said containers clamped in the gripping group, an abutment surface of said horizontal plate in extended position, and actuator means of said support plate.

16. Apparatus according to claim 15, also comprising a pincer group suitable for locking a portion of said film at the group of containers, the pincer group comprising:

a jaw, able to move in abutment against said horizontal plate of the support group to lock the film and prevent it from sliding with respect to the horizontal plate of the support group, and actuator means of said jaw suitable for thrusting it along said longitudinal axis under the horizontal plate of the support group in extended position, and actuator means of said jaw suitable for thrusting it against the horizontal plate of the support group in extended position.

17. Apparatus according to claim 16, wherein said element for cutting the film comprises its own independent actuator means or it comprises actuator means fixedly connected to said support group and/or to said pincer group.

18. Process for packaging groups of containers for liquids, comprising the steps of:

a) forming a group of containers having a longitudinal axis;

b) wrapping said group of containers around an axis with a film of non-heat-shrinking extensible plastic material;

c) locking said film at a bundle in formation;

d) cutting the film to separate a portion wound on the bundle from a remaining part, wherein cutting the film is carried out with a cutting element able to move alternately in a direction parallel to said axis.

19. Process according to claim 18, wherein locking said film is carried out through a pincer group comprising at least one jaw and relative actuator means suitable for thrusting the jaw against an abutment surface, and wherein said cutting element comprises relative actuator means that are independent or fixedly connected to said pincer group.

20. Process according to claim 18, wherein wrapping said group of containers comprises wrapping the film according to a plurality of revolutions around the group of containers.

* * * * *